US008880404B2

(12) United States Patent
Villette et al.

(10) Patent No.: US 8,880,404 B2
(45) Date of Patent: Nov. 4, 2014

(54) DEVICES FOR ADAPTIVELY ENCODING AND DECODING A WATERMARKED SIGNAL

(75) Inventors: Stephane Pierre Villette, San Diego, CA (US); Daniel J. Sinder, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 406 days.

(21) Appl. No.: 13/275,997

(22) Filed: Oct. 18, 2011

(65) Prior Publication Data

US 2012/0203561 A1 Aug. 9, 2012

Related U.S. Application Data

(60) Provisional application No. 61/440,313, filed on Feb. 7, 2011.

(51) Int. Cl.

| | |
|---|---|
| ***G10L 21/00*** | (2013.01) |
| ***G10L 19/018*** | (2013.01) |
| ***G10L 19/02*** | (2013.01) |
| *G10L 19/005* | (2013.01) |
| *G10L 19/09* | (2013.01) |
| *G10L 19/107* | (2013.01) |
| *G10L 19/24* | (2013.01) |

(52) U.S. Cl.

CPC ..... *G10L 19/018* (2013.01); *G10L 19/0212* (2013.01); *G10L 19/005* (2013.01); *G10L 19/09* (2013.01); *G10L 19/107* (2013.01); *G10L 19/24* (2013.01)

USPC ..... 704/273; 704/205; 704/200.1; 704/500; 380/28; 380/54; 380/232; 380/202

(58) Field of Classification Search

CPC ..... G10L 19/018; G10L 19/005; G10L 19/09; G10L 19/107; G10L 19/24; G10L 19/0212; G10L 19/035; G10L 21/038; G10L 25/18; G06T 1/0021; G06T 1/0028; G06T 1/0042; G06T 2201/0053; G06T 3/00; H04N 1/32128; H04N 2201/3233

USPC ..... 704/200.1, 205, 500, 273; 380/28, 54, 380/232, 202; 713/716, 179; 382/100, 251

See application file for complete search history.

(56) References Cited

U.S. PATENT DOCUMENTS 6,330,672 B1 * 12/2001 Shur ..... 713/176
6,332,030 B1 * 12/2001 Manjunath et al. ..... 382/100

(Continued)

FOREIGN PATENT DOCUMENTS

CN 1437169 A 8/2003
CN 1575492 A 2/2005

(Continued)

OTHER PUBLICATIONS

Ding, H.,"Wideband Audio Over Narrowband Low-Resolution Media," IEEE International Conference on Acoustics, Speech, and Signal Processing, 2004. (ICASSP '04). vol. 1, May 17-21, 2004, pp. 1-489 to 1-492.

(Continued)

*Primary Examiner* — Vijay B Chawan
(74) *Attorney, Agent, or Firm* — Austin Rapp & Hardman

(57) ABSTRACT

An electronic device configured for adaptively encoding a watermarked signal is described. The electronic device includes modeler circuitry that determines watermark data based on a first signal. The electronic device also includes coder circuitry coupled to the modeler circuitry. The coder circuitry determines a low priority portion of a second signal and embeds the watermark data into the low priority portion of the second signal to produce a watermarked second signal.

38 Claims, 10 Drawing Sheets

(56) References Cited

U.S. PATENT DOCUMENTS

| | | | | |
|---|---|---|---|---|
| 6,418,424 | B1 * | 7/2002 | Hoffberg et al. | 706/21 |
| 6,493,457 | B1 * | 12/2002 | Quackenbush et al. | 382/100 |
| 7,596,492 | B2 | 9/2009 | Sung et al. | |
| 7,860,992 | B2 | 12/2010 | Robinson | |
| 7,974,846 | B2 * | 7/2011 | Tsuchinaga et al. | 704/272 |
| 2001/0049788 | A1 * | 12/2001 | Shur | 713/179 |
| 2002/0128839 | A1 | 9/2002 | Lindgren et al. | |
| 2003/0088327 | A1 | 5/2003 | Taori et al. | |
| 2004/0068399 | A1 | 4/2004 | Ding | |
| 2005/0002526 | A1 | 1/2005 | Choi et al. | |
| 2005/0094848 | A1 | 5/2005 | Carr et al. | |
| 2006/0045309 | A1 * | 3/2006 | Suthaharan | 382/100 |
| 2006/0075241 | A1 * | 4/2006 | Deguillaume et al. | 713/176 |
| 2006/0239502 | A1 | 10/2006 | Petrovic et al. | |
| 2006/0282263 | A1 | 12/2006 | Vos et al. | |
| 2007/0217626 | A1 * | 9/2007 | Sharma et al. | 381/100 |
| 2008/0250091 | A1 * | 10/2008 | Lacy et al. | 708/203 |
| 2008/0263359 | A1 | 10/2008 | Radzishevsky | |
| 2009/0094264 | A1 | 4/2009 | Nurminen et al. | |
| 2010/0106269 | A1 | 4/2010 | Garudadri et al. | |
| 2010/0228541 | A1 | 9/2010 | Oshikiri | |
| 2011/0131047 | A1 | 6/2011 | Geiser et al. | |
| 2011/0208514 | A1 * | 8/2011 | Tsuchinaga et al. | 704/201 |
| 2012/0022879 | A1 * | 1/2012 | Srinivasan | 704/500 |
| 2012/0203555 | A1 | 8/2012 | Villette et al. | |
| 2012/0203556 | A1 | 8/2012 | Villette et al. | |
| 2012/0203561 | A1 * | 8/2012 | Villette et al. | 704/500 |

FOREIGN PATENT DOCUMENTS

| | | | |
|---|---|---|---|
| CN | 101262418 | A | 9/2008 |
| CN | 101271690 | A | 9/2008 |
| CN | 101345054 | A | 1/2009 |
| CN | 101577605 | A | 11/2009 |
| EP | 1503369 | A2 | 2/2005 |
| EP | 1959432 | A1 | 8/2008 |
| JP | H10513571 | A | 12/1998 |
| JP | 2003295879 | A | 10/2003 |
| JP | 2004069963 | A | 3/2004 |
| JP | 2004310117 | A | 11/2004 |
| JP | 2004348120 | A | 12/2004 |
| JP | 2005049794 | A | 2/2005 |
| JP | 2005506584 | A | 3/2005 |
| JP | 2005513543 | A | 5/2005 |
| JP | 2006524358 | A | 10/2006 |
| JP | 2007048340 | A | 2/2007 |
| JP | 2008539671 | A | 11/2008 |
| JP | 2010020333 | A | 1/2010 |
| TW | 200943899 | A | 10/2009 |
| WO | WO-0062501 | A2 | 10/2000 |
| WO | WO03036624 | A1 | 5/2003 |
| WO | WO03047138 | A1 | 6/2003 |
| WO | WO-2004090886 | A1 | 10/2004 |
| WO | WO-2006116394 | A2 | 11/2006 |
| WO | WO2007043811 | A1 | 4/2007 |
| WO | WO-2007063913 | A1 | 6/2007 |
| WO | WO2008016947 | | 2/2008 |
| WO | WO-2010059342 | A1 | 5/2010 |

OTHER PUBLICATIONS

Geiser, B., et al., "Artificial Bandwidth Extension of Speech Supported by Watermark-Transmitted Side Information", Inter Speech, Institute of Communication Systems and Data Processing, Sep. 4-8, 2005, pp. 1497-1500.

Geiser, B., et al., "Backwards Compatible wideband Telephony in Mobile Networks: CELP Watermarking and Bandwidth Extension", IEEE, Institute of Communication Systems and Data Processing, 2007, pp. IV 533-536.

Geiser, B., et al., "Robust Wideband Enhancement of Speech by Combined Coding and Artificial Bandwidth Extension", Institute of Communication Systems and Data Processing, Jan. 2005, pp. 21-24.

Loo, P., et al., "Watermark Detection Based on the Properties of Error Control Codes", IEE Proc.-Vis. Image Signal Process., vol. 150, No. 2, Apr. 2003, pp. 115-121.

Luo, Z. et al., "Wideband Audio Over Narrow Band Based on Digital Watermarking", IEEE, School of Information Technology and Engineering, Jun. 2010, pp. 697-701.

Nishimura, A. et al., "Data Hiding in Pitch Delay Data of the Adaptive Multi-Rate Narrow-band Speech Codec", IEEE, Fifth International Conference on Intelligent Information Hiding and Multimedia Signal Processing, 2009, pp. 483-486.

Vary, P. et al., "Steganographic Wideband Telephony Using Narrowband Speech Codecs", Conference Record of the Forty-First Asilomar Conference on Signals, Systems and Computers, 2007, pp. 1475-1479, Nov. 4-7, 2007. doi: 10.1109/ACSSC.2007.4487475.

Bernd Geiser., et al., "High rate data hiding in ACELP speech codecs", Acoustics, Speech and Signal Processing, 2008, ICASSP 2008, IEEE International Conference on, IEEE, Piscataway, NJ, USA, Mar. 31, 2008, pp. 4005-4008, XP031251474, ISBN : 978-1-4244-1483-3 paragraph [03.2] ; table 2.

International Search Report and Written Opinion—PCT/US2011/067405—ISA/EPO—Mar. 29, 2012.

* cited by examiner

DEVICES FOR ADAPTIVELY ENCODING AND DECODING A WATERMARKED SIGNAL

RELATED APPLICATIONS

This application is related to and claims priority from U.S. Provisional Patent Application Ser. No. 61/440,313 filed Feb. 7, 2011, for "ADAPTIVE WATERMARKING."

TECHNICAL FIELD

The present disclosure relates generally to electronic devices. More specifically, the present disclosure relates to devices for adaptively encoding and decoding a watermarked signal.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform functions faster, more efficiently or with higher quality are often sought after.

Some electronic devices (e.g., cellular phones, smart phones, computers, etc.) use audio or speech signals. These electronic devices may encode speech signals for storage or transmission. For example, a cellular phone captures a user's voice or speech using a microphone. For instance, the cellular phone converts an acoustic signal into an electronic signal using the microphone. This electronic signal may then be formatted for transmission to another device (e.g., cellular phone, smart phone, computer, etc.) or for storage.

Improved quality or additional capacity in a communicated signal is often sought for. For example, cellular phone users may desire greater quality in a communicated speech signal. However, improved quality or additional capacity may often require greater bandwidth resources and/or new network infrastructure. As can be observed from this discussion, systems and methods that allow efficient signal communication may be beneficial.

SUMMARY

An electronic device configured for adaptively encoding a watermarked signal is disclosed. The electronic device includes modeler circuitry that determines watermark data based on a first signal. The electronic device also includes coder circuitry coupled to the modeler circuitry. The coder circuitry determines a low priority portion of a second signal and embeds the watermark data into the low priority portion of the second signal to produce a watermarked second signal. The low priority portion of the second signal may be perceptually less important than another portion of the second signal. The first signal may be a higher frequency component signal and the second signal may be a lower frequency component signal. The modeler circuitry and the coder circuitry may be included in an audio codec.

Determining the low priority portion of the second signal may be based on a current frame and a past frame. Determining the low priority portion of the second signal may include determining one or more high priority codebook tracks based on the second signal. Determining the low priority portion of the second signal may further include designating one or more low priority codebook tracks that are not the high priority codebook tracks. Embedding the watermark data into the low priority portion of the second signal may include embedding the watermark data on the one or more low priority codebook tracks.

Determining the one or more high priority codebook tracks may be based on a long term prediction (LTP) contribution. Determining the one or more high priority codebook tracks may be based on a memory-limited long term prediction (LTP) contribution. The one or more high priority codebook tracks may be used to represent pitch.

An electronic device for decoding an adaptively encoded watermarked signal is also disclosed. The electronic device includes portion determination circuitry that determines a low priority portion of a watermarked bitstream. The electronic device also includes modeler circuitry coupled to the portion determination circuitry. The modeler circuitry extracts watermark data from the low priority portion of the watermarked bitstream and obtains a first signal based on the watermark data. The electronic device further includes decoder circuitry that decodes the watermarked bitstream to obtain a second signal. The electronic device may also include combining circuitry that combines the first signal and the second signal. The portion determination circuitry, the modeler circuitry and the decoder circuitry may be included in an audio codec. The low priority portion of the watermarked bitstream may include information that is perceptually less important.

Determining a low priority portion of the watermarked bitstream may be based on a current frame and a past frame. Determining a low priority portion of the watermarked bitstream may be based on determining one or more high priority codebook tracks based on the watermarked bitstream. The low priority portion may include one or more low priority codebook tracks.

Determining the one or more high priority codebook tracks may be based on a long term prediction (LTP) contribution. Determining the one or more high priority codebook tracks may be based on a memory-limited long term prediction (LTP) contribution.

A method for adaptively encoding a watermarked signal on an electronic device is also disclosed. The method includes obtaining a first signal and a second signal. The method also includes determining a low priority portion of the second signal. The method further includes determining watermark data based on the first signal. The method additionally includes embedding the watermark data into the low priority portion of the second signal to produce a watermarked second signal.

A method for decoding an adaptively encoded watermarked bitstream on an electronic device is also disclosed. The method includes receiving a signal. The method also includes extracting a watermarked bitstream based on the signal. The method further includes determining a low priority portion of the watermarked bitstream. The method additionally includes extracting watermark data from the low priority portion of the watermarked bitstream. The method also includes obtaining a first signal based on the watermark data. Furthermore, the method includes decoding the watermarked bitstream to obtain a second signal.

A computer-program product for adaptively encoding a watermarked signal is also disclosed. The computer-program product includes a non-transitory tangible computer-readable medium with instructions. The instructions include code for causing an electronic device to obtain a first signal and a second signal. The instructions also include code for causing the electronic device to determine a low priority portion of the second signal. The instructions further include code for causing the electronic device to determine watermark data based on the first signal. The instructions additionally include code for causing the electronic device to embed the watermark data into the low priority portion of the second signal to produce a watermarked second signal.

A computer-program product for decoding an adaptively encoded watermarked bitstream is also disclosed. The computer-program product includes a non-transitory tangible computer-readable medium with instructions. The instructions include code for causing an electronic device to receive a signal. The instructions also include code for causing the electronic device to extract a watermarked bitstream based on the signal. The instructions further include code for causing the electronic device to determine a low priority portion of the watermarked bitstream. The instructions additionally include code for causing the electronic device to extract watermark data from the low priority portion of the watermarked bitstream. The instructions also include code for causing the electronic device to obtain a first signal based on the watermark data. Furthermore, the instructions include code for causing the electronic device to decode the watermarked bitstream to obtain a second signal.

An apparatus for adaptively encoding a watermarked signal is also disclosed. The apparatus includes means for obtaining a first signal and a second signal. The apparatus also includes means for determining a low priority portion of the second signal. The apparatus further includes means for determining watermark data based on the first signal. The apparatus additionally includes means for embedding the watermark data into the low priority portion of the second signal to produce a watermarked second signal.

An apparatus for decoding an adaptively encoded watermarked bitstream is also disclosed. The apparatus includes means for receiving a signal. The apparatus also includes means for extracting a watermarked bitstream based on the signal. The apparatus further includes means for determining a low priority portion of the watermarked bitstream. The apparatus additionally includes means for extracting watermark data from the low priority portion of the watermarked bitstream. The apparatus also includes means for obtaining a first signal based on the watermark data. Furthermore, the apparatus includes means for decoding the watermarked bitstream to obtain a second signal.

DETAILED DESCRIPTION

Figure 1:
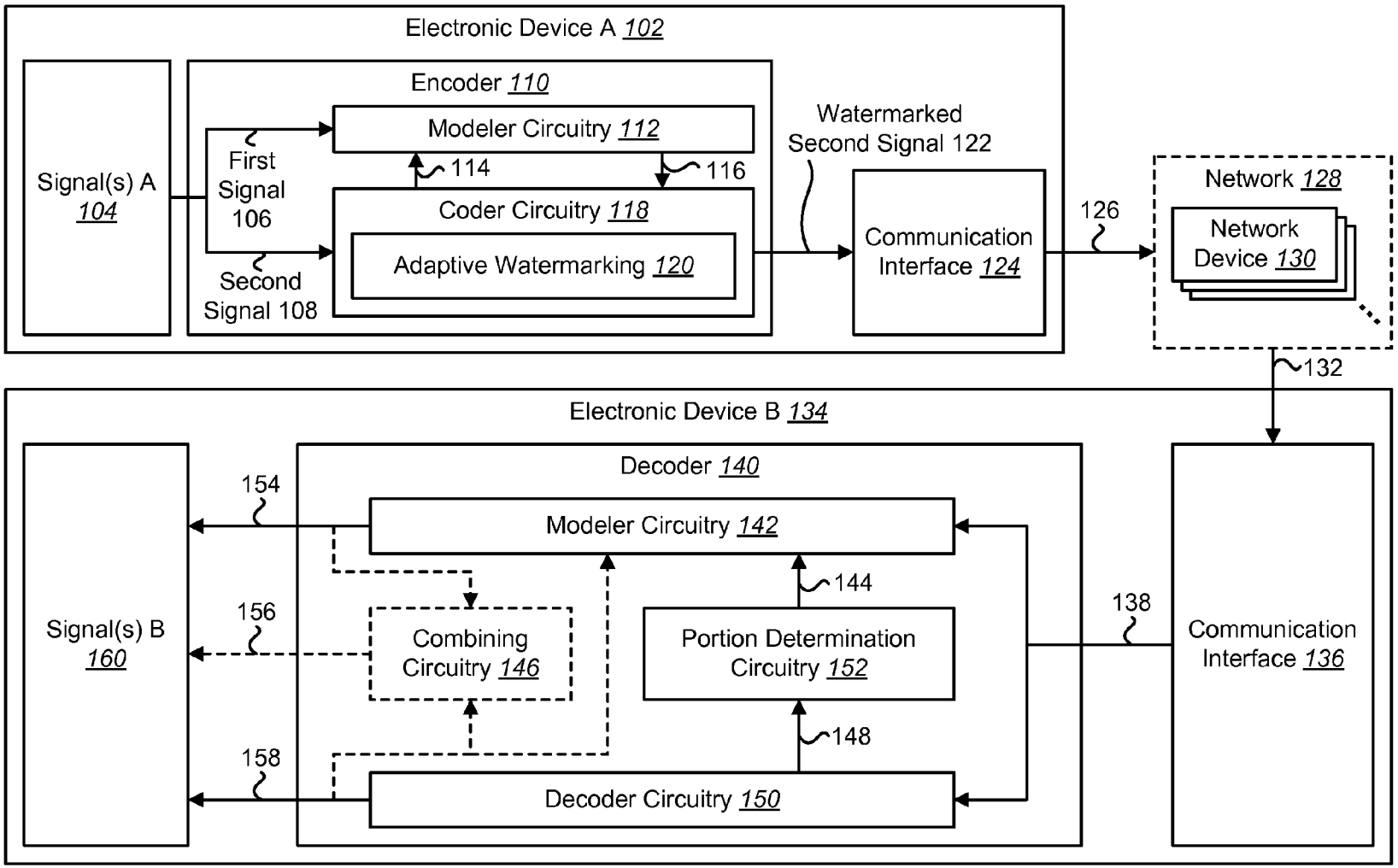
FIG. 1 is a block diagram illustrating one configuration of electronic devices, in which systems and methods for adaptively encoding and decoding a watermarked signal may be implemented.

The systems and methods disclosed herein may be applied to a variety of electronic devices. Examples of electronic devices include voice recorders, video cameras, audio players (e.g., Moving Picture Experts Group-1 (MPEG-1) or MPEG-2 Audio Layer 3 (MP3) players), video players, audio recorders, desktop computers, laptop computers, personal digital assistants (PDAs), gaming systems, etc. One kind of electronic device is a communication device, which may communicate with another device. Examples of communication devices include telephones, laptop computers, desktop computers, cellular phones, smartphones, wireless or wired modems, e-readers, tablet devices, gaming systems, cellular telephone base stations or nodes, access points, wireless gateways and wireless routers.

An electronic device or communication device may operate in accordance with certain industry standards, such as International Telecommunication Union (ITU) standards and/or Institute of Electrical and Electronics Engineers (IEEE) standards (e.g., Wireless Fidelity or "Wi-Fi" standards such as 802.11a, 802.11b, 802.11 g, 802.11n and/or 802.11ac). Other examples of standards that a communication device may comply with include IEEE 802.16 (e.g., Worldwide Interoperability for Microwave Access or "WiMAX"), Third Generation Partnership Project (3GPP), 3GPP Long Term Evolution (LTE), Global System for Mobile Telecommunications (GSM) and others (where a communication device may be referred to as a User Equipment (UE), Node B, evolved Node B (eNB), mobile device, mobile station, subscriber station, remote station, access terminal, mobile terminal, terminal, user terminal, subscriber unit, etc., for example). While some of the systems and methods disclosed herein may be described in terms of one or more standards, this should not limit the scope of the disclosure, as the systems and methods may be applicable to many systems and/or standards.

It should be noted that some communication devices may communicate wirelessly and/or may communicate using a wired connection or link. For example, some communication devices may communicate with other devices using an Ethernet protocol. The systems and methods disclosed herein may be applied to communication devices that communicate wirelessly and/or that communicate using a wired connection or link. In one configuration, the systems and methods disclosed herein may be applied to a communication device that communicates with another device using a satellite.

As used herein, the term "couple" may denote a direct connection or an indirect connection. For example, if a first component is coupled to a second component, the first component may be directly connected to the second component or may be indirectly connected to the second component (through a third component, for example).

The systems and methods disclosed herein describe adaptive watermarking. For example, the systems and methods disclosed herein may be used for adaptive watermarking for algebraic code excited linear prediction (ACELP) codecs.

Watermarking or data hiding in speech codec bitstreams allows the transmission of extra data in-band with no changes to the network infrastructure. This can be used for a range of applications (e.g., authentication, data hiding, etc.) without incurring the high costs of deploying new infrastructure for a new codec. One possible application of the systems and methods disclosed herein is bandwidth extension, in which one codec's bitstream (e.g., a deployed codec) is used as a carrier for hidden bits containing information for high quality bandwidth extension. Decoding the carrier bitstream and the hidden bits allows synthesis of a bandwidth that is greater than the bandwidth of the carrier codec (e.g., a wider bandwidth may be achieved without altering the network infrastructure).

For example, a standard narrowband codec can be used to encode a 0-4 kilohertz (kHz) low-band part of speech, while a 4-7 kHz high-band part is encoded separately. The bits for the high band may be hidden within the narrowband speech bitstream. In this case, wideband may be decoded at the receiver despite using the legacy narrowband bitstream. In another example, a standard wideband codec may be used to encode a 0-7 kHz low-band part of speech, while a 7-14 kHz high-band part is encoded separately and hidden in the wideband bitstream. In this case, super-wideband may be decoded at the receiver despite using the legacy wideband bitstream.

Currently known watermarking techniques may hide bits on a fixed codebook (FCB) of an algebraic code excited linear prediction (ACELP) coder (e.g., adaptive multi-rate narrowband or AMR-NB) by hiding a fixed number of bits per FCB track. The bits are hidden by restricting the number of allowed pulse combinations. In the case of AMR-NB, where there are two pulses per track, one approach includes constraining the pulse positions so that an exclusive OR (XOR) of the two pulse positions on a given track are equal to the watermark to transmit. One or two bits per track may be transmitted this way.

In practice, this can add significant distortion as it may significantly alter the main pitch pulses. This may be especially detrimental for bandwidth extension applications where the low band excitation is used to generate the high band excitation, as the low band degradation may also cause degradation in the high band.

This is the case when using high-band models that extend the low-band residual, such as the enhanced variable rate wideband codec (EVRC-WB) non-linear extension high-band model, on top of a carrier codec such as AMR-NB or adaptive multi-rate wideband (AMR-WB).

In the systems and methods disclosed herein, the watermark is made adaptive. Instead of embedding a fixed number of bits per pulse track (e.g., one or two), it may be attempted to determine which tracks are perceptually most important. This may be done, for example, using information already present at both an encoder and decoder, such that information indicating which tracks are perceptually most important does not need to be additionally or separately transmitted. In one configuration, a long term prediction (LTP) contribution may be used to protect the most important tracks from the watermark. For instance, the LTP contribution normally exhibits clear peaks at the main pitch pulse, and may be available already at both encoder and decoder.

In some configurations of the systems and methods disclosed herein, AMR-NB 12.2 may be used. Other rates of AMR-NB may have a similar or dissimilar configuration. In AMR-NB 12.2, there are five tracks of eight positions per 40-sample sub-frame. In one example, two tracks corresponding to the highest absolute values of the LTP contribution may be deemed important (or designated "high priority" tracks) and are not watermarked. The other three tracks are likely to be less important (and may be designated or referred to as "low priority" tracks, for example), and may receive a watermark. Thus, if the three remaining tracks are watermarked with two bits each, this leads to six bits of watermark per five millisecond (ms) subframe, for a total of 1.2 kilobits per second (kbps) carried in the watermark with reduced (e.g., minimal) impact to the main pitch pulse.

One refinement provided by the systems and methods disclosed herein may include replacing the LTP contribution by a memory-limited LTP contribution because the LTP signal is sensitive to errors and packet losses and errors may propagate indefinitely. This may lead to the encoder and decoder being out of sync for long periods after an erasure or bit errors. Instead, a memory-limited version of the LTP may be constructed based only on the quantized pitch values and codebook contributions of the last N frames plus the current frame. Gains may be set to unity. For example, with N=2, it was observed that performance is equivalent to that obtained with the original LTP contribution, while performance under errors was greatly improved. It should be noted that the original LTP may be used for the low band coding. In some configurations, the memory-limited LTP may be used solely for determining the priority of the tracks for watermarking purposes.

Adapting the watermark to the speech characteristics may allow better speech quality by hiding the watermark where it is perceptually less important. In particular, preserving the pitch pulse may have a positive impact on speech quality. Other documented watermarking techniques for ACELP do not address this issue. When the systems and methods described herein are not used, for instance, the quality impact of a watermark at the same bit rate may be more severe.

In some configurations, the systems and methods disclosed herein may be used to provide a codec that is a backward interoperable version of narrowband AMR 12.2 (where 12.2 may refer to a bit rate of 12.2 kilobits per second (kbps)). For convenience, this codec may be referred to as "eAMR" herein, though the codec could be referred to using a different term. eAMR may have the ability to transport a "thin" layer of wideband information hidden within a narrowband bit stream. This may provide true wideband encoding and not blind bandwidth extension. eAMR may make use of watermarking (e.g., steganography) technology and may require no out-of-band signaling. The watermark used may have a negligible impact on narrowband quality (for legacy interoperation). With the watermark, narrowband quality may be slightly degraded in comparison with AMR 12.2, for example. In some configurations, an encoder may detect a legacy remote (through not detecting a watermark on the return channel, for example) and stop adding watermark, returning to legacy AMR 12.2 operation.

A comparison between eAMR and Adaptive Multi-Rate Wideband (AMR-WB) is given hereafter. eAMR may provide true wideband quality and not blind bandwidth extension. eAMR may use a bit rate of 12.2 kilobits per second (kbps). In some configurations, eAMR may require new handsets (with wideband acoustics, for example). eAMR may be transparent to existing GSM Radio Access Network (GRAN) and/or Universal Terrestrial Radio Access Network (UTRAN) infrastructure (thus having no network cost impact, for example). eAMR may be deployed on both 2G and 3G networks without any software upgrade in the core network. eAMR may require tandem-free/transcoder-free operation (TFO/TrFO) of a network for wideband quality. eAMR may automatically adapt to changes in TFO/TrFO. It should be noted that in some cases, some TrFO networks may manipulate fixed codebook (FCB) gain bits. However, this may or may not affect eAMR operation.

eAMR may be compared to AMR-WB as follows. AMR-WB may offer true wideband quality. AMR-WB may use a bit rate of 12.65 kbps. AMR-WB may require new handsets (with wideband acoustics, for example) and infrastructure modifications. AMR-WB may require a new Radio Access Bearer (RAB) and associated deployment costs. Implementing AMR-WB may be a significant issue with the legacy 2G network and may require overall mobile switching center (MSC) restructuring. AMR-WB may require TFO/TrFO for wideband quality. It should be noted that changes in TFO/TrFO may be potentially problematic for AMR-WB.

More detail on one example of an AMR 12.2 ACELP fixed codebook is given hereafter. The codebook excitation is made of pulses and allows efficient computations. In Enhanced Full Rate (EFR), each 20 millisecond (ms) frame (of 160 samples, for example) is split into 4×5 ms frames of 40 samples. Each subframe of 40 samples is split into five interleaved tracks with eight positions per track. Two pulses and one sign bit may be used per track, where the order of pulses determines the second sign. Stacking may be allowed. (2*3+1)*5=35 bits may be used per subframe. One example of tracks, pulses, amplitudes and positions that may be used according to an ACELP fixed codebook is given in Table (1).

TABLE (1)

| Track | Pulses | Amplitudes | Positions |
|---|---|---|---|
| 1 | 0, 5 | ±1, ±1 | 0, 5, 10, 15, 20, 25, 30, 35 |
| 2 | 1, 6 | ±1, ±1 | 1, 6, 11, 16, 21, 26, 31, 36 |
| 3 | 2, 7 | ±1, ±1 | 2, 7, 12, 17, 22, 27, 32, 37 |
| 4 | 3, 8 | ±1, ±1 | 3, 8, 14, 18, 23, 28, 33, 38 |
| 5 | 4, 9 | ±1, ±1 | 4, 9, 15, 19, 24, 29, 34, 39 |

One example of a watermarking scheme is given as follows. A watermark may be added to a fixed codebook (FCB) by limiting the pulse combinations allowed. Watermarking in an AMR 12.2 FCB may be accomplished in one configuration as follows. In each track, (pos0ˆpos1) & 001=1 watermarked bit, where the operator "ˆ" refers to a logical exclusive or (XOR) operation, "&" refers to a logical AND operation and pos0 and post refer to indexes. Basically, the XOR of the last bit of the two indexes pos0 and post may be constrained to be equal to the chosen bit of information to be transmitted (e.g., the watermark). This leads to one bit per track (e.g., five bits per subframe) providing 20 bits/frame=1 kbps. Alternatively, (pos0ˆpos1) & 011=2 watermarked bits, resulting in 2 kbps. For instance, the XOR of the two least significant bits (LSBs) of the indexes may be constrained to be the two bits of information to be transmitted. Watermarking may be added by limiting the searches in the AMR FCB search. For example, a search may be performed over pulse positions that will decode into the correct watermark. This approach may provide low complexity. In this approach, however, the main pitch pulse may be significantly affected (e.g., watermarking may prevent pulse stacking).

In accordance with the systems and methods disclosed herein, tracks with the most impact may be identified and not watermarked. In one approach, a long term prediction (LTP) contribution may be used to identify two important (e.g., "high priority") tracks and three less important (e.g., "low priority") tracks. Using this approach may allow 2*0 bits+3*2 bits=6 bits/(5 ms subframe)=1.2 kbps. However, this approach may require an identical LTP contribution at an encoder and a decoder. Bit Error Rate (BER) or Frame Error Rate (FER) and Discontinuous Transmission (DTX) may cause a mismatch over multiple frames. More specifically, BER and FER may cause a mismatch. In theory DTX should not, since both encoder and decoder should be aware of DTX at the same time. However, it is one peculiarity of AMR-NB/enhanced full rate (EFR) codecs that DTX may very occasionally cause such mismatches.

In another approach, limited-memory LTP may be used. In this approach, an LTP contribution may be recomputed using only M past frames of excitation and pitch lags. This may eliminate error propagation beyond M frames. In one configuration, M=2 may provide good pulse identification and performs adequately with DTX and FER. It should be noted that a single frame loss may imply that potentially three frames are lost for a high band when a bad frame indication from the low band is provided to the high band. More specifically, a bad frame indication (BFI) is a flag that a channel decoder provides to a speech decoder, indicating when it has failed to properly decode a frame. The decoder may then ignore the received data and perform error concealment. For example, a single frame loss may cause M+1 frames to have an incorrect limited-memory LTP. Therefore, each time a BFI is received for the codec, it may be indicated to the high band decoder that the next M+1 frames of data are invalid and should not be used. Error concealment may then be performed on the high band (e.g., suitable parameters may be determined from the past, rather than using the decoded values).

It should be noted that although a 12.2 kbps bit rate is given as an example herein, the systems and methods disclosed may be applied to other rates of eAMR. For example, one operating point of eAMR is 12.2 kbps. In one configuration of the systems and methods disclosed herein, lower rates may be used (e.g., switched to) in poor channel and/or poor network conditions. Thus, bandwidth switching (between narrowband and wideband, for example) may be a challenge. Wideband speech, for example, may be maintained with lower rates of eAMR. Each rate may use a watermarking scheme. For example, the watermarking scheme used for a 10.2 kbps rate may be similar to a scheme used for the 12.2 kbps rate. A limited-memory LTP scheme could be used for other rates. Table (2) illustrates examples of bit allocations per frame for differing rates. More specifically, Table (2) illustrates a number of bits per frame that may be allocated for communicating different types of information, such as Line Spectral Frequencies (LSF), gain shape, gain frame and Cyclic Redundancy Check (CRC).

TABLE 2

| Rate (kbps) | 12.2 | 10.2 | 7.95 | 7.4 | 6.7 | 5.9 | 5.15 | 4.75 |
|---|---|---|---|---|---|---|---|---|
| LSF | 8 | 8 | 8 | 8 | 4 | 4 | 4 | 4 |
| Gain Shape | 8 | 8 | 0 | 0 | 0 | 0 | 0 | 0 |
| Gain Frame | 4 | 4 | 4 | 4 | 4 | 4 | 4 | 4 |
| CRC | 4 | 4 | 4 | 4 | 4 | 4 | 4 | 4 |
| Total | 24 | 24 | 16 | 16 | 12 | 12 | 12 | 12 |

One configuration of the systems and methods disclosed herein may be used for the extension of code-excited linear prediction (CELP) speech coders using watermarking techniques to embed data. Wideband (e.g., 0-7 kilohertz (kHz)) coding of speech provides superior quality to narrowband (e.g., 0-4 kHz) coding of speech. However, the majority of existing mobile communication networks support narrowband coding only (e.g., adaptive multi-rate narrowband (AMR-NB)). Deploying wideband coders (e.g., adaptive multi-rate wideband (AMR-WB)) may require substantial and costly changes to infrastructure and service deployment.

Furthermore, the next generation of services may support wideband coders (e.g., AMR-WB), while super-wideband (e.g., 0-14 kHz) coders are being developed and standardized. Again, operators may eventually face the costs of deploying yet another codec to move customers to super-wideband.

One configuration of the systems and methods disclosed herein may use an advanced model that can encode additional bandwidth very efficiently and hide this information in a bitstream already supported by existing network infrastructure. The information hiding may be performed by watermarking the bitstream. One example of this technique watermarks the fixed codebook of a CELP coder. For example, the upper band of a wideband input (e.g., 4-7 kHz) may be encoded and carried as a watermark in a narrowband coder's bitstream. In another example, the upper band of a super-wideband input (e.g., 7-14 kHz) may be encoded and carried as a watermark in a wideband coder's bitstream. Other secondary bitstreams, perhaps unrelated to bandwidth extension, may be carried as well. This technique allows the encoder to produce a bitstream compatible with existing infrastructures. A legacy decoder may produce a narrowband output with a quality similar to standard encoded speech (without the watermark, for example), while a decoder that is aware of the watermark may produce wideband speech.

Various configurations are now described with reference to the Figures, where like element names may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of electronic devices 102, 134 in which systems and methods for adaptively encoding and decoding a watermarked signal may be implemented. Examples of electronic device A 102 and electronic device B 134 may include wireless communication devices (e.g., cellular phones, smart phones, personal digital assistants (PDAs), laptop computers, e-readers, etc.) and other devices.

Electronic device A 102 may include an encoder block/module 110 and/or a communication interface 124. The encoder block/module 110 may be used to encode and watermark a signal. The communication interface 124 may transmit one or more signals to another device (e.g., electronic device B 134).

Electronic device A 102 may obtain one or more signals A 104, such as audio or speech signals. For example, electronic device A 102 may capture signal A 104 using a microphone or may receive signal A 104 from another device (e.g., a Bluetooth headset). In some configurations, signal A 104 may be divided into different component signals (e.g., a higher frequency component signal and a lower frequency component signal, a monophonic signal and a stereo signal, etc.). In other configurations, unrelated signals A 104 may be obtained. Signal(s) A 104 may be provided to modeler circuitry 112 and coder circuitry 118 in an encoder 110. For example, a first signal 106 (e.g., signal component) may be provided to the modeler circuitry 112, while a second signal 108 (e.g., another signal component) is provided to the coder circuitry 118.

It should be noted that one or more of the elements included in electronic device A 102 may be implemented in hardware, software or a combination of both. For instance, the term "circuitry" as used herein may indicate that an element may be implemented using one or more circuit components (e.g., transistors, resistors, registers, inductors, capacitors, etc.), including processing blocks and/or memory cells. Thus, one or more of the elements included in electronic device A 102 may be implemented as one or more integrated circuits, application specific integrated circuits (ASICs), etc., and/or using a processor and instructions. It should also be noted that the term "block/module" may be used to indicate that an element may be implemented in hardware, software or a combination of both.

The coder circuitry 118 may perform coding on the second signal 108. For example, the coder circuitry 118 may perform adaptive multi-rate (AMR) coding on the second signal 108. For instance, the coder circuitry 118 may produce a coded bitstream that watermark data 116 may be embedded into. The modeler circuitry 112 may determine the watermark data 116 (e.g., parameters, bits, etc.) based on the first signal 106 that may be embedded into the second signal 108 (e.g., "carrier" signal). For example, the modeler circuitry 112 may separately encode the first signal 106 into watermark data 116 that can be embedded into the coded bitstream. In yet another example, the modeler circuitry 112 may provide bits from the first signal 106 (without modification) as watermark data 116 to the coder circuitry 118. In another example, the modeler circuitry 112 may provide parameters (e.g., high band bits) as watermark data 116 to the coder circuitry 118. The coded second signal 108 with the embedded watermark signal may be referred to as a watermarked second signal 122.

The coder circuitry 118 may code (e.g., encode) the second signal 108. In some configurations, this coding may produce data 114, which may be provided to the modeler circuitry 112. In one configuration, the modeler circuitry 112 may use an EVRC-WB model to model higher frequency components (from the first signal 106) that relies on lower frequency components (from the second signal 108) that may be encoded by the coder circuitry 118. Thus, the data 114 may be provided to the modeler circuitry 112 for use in modeling the higher frequency components. The resulting higher frequency component watermark data 116 may then be embedded into the second signal 108 by the coder circuitry 118, thereby producing the watermarked second signal 122.

The coder circuitry 118 may include an adaptive watermarking block/module 120. The adaptive watermarking block/module 120 may determine a low priority portion of the second signal 108 and embed the watermark data 116 into the low priority portion of the second signal 108. One example of the coder circuitry 118 is an algebraic code excited linear prediction (ACELP) coder. In this example, the coder circuitry 118 may use a codebook (e.g., fixed codebook (FCB)) in order to encode the second signal 108. The codebook may use a number of tracks in the encoding process. For example, AMR-NB coding uses five tracks of eight positions for a 40-sample sub-frame. The adaptive watermarking block/module 120 may use the second signal 108 to determine one or more high priority tracks. For example, high priority tracks may be tracks on which a pitch pulse is represented. In one configuration, the adaptive watermarking block/module 120 may make this determination based on a long term prediction (LTP) filter (or pitch filter) contribution. For example, the adaptive watermarking block/module 120 may examine the LTP filter output to determine the largest LTP contribution for a designated number of tracks. For instance, the largest energy in the LTP filter output may be found, taking a largest maximum for each track. In one configuration, the two tracks with the largest LTP contribution may be designated "high priority tracks" or important tracks. One or more remaining tracks may be designated as "low priority tracks" or less important tracks.

This approach may be used since all tracks may not have the same impact on speech quality. For example, it may be important in speech coding to properly represent the main pitch pulse. Accordingly, if there is a pitch pulse in a subframe, the systems and methods disclosed herein may ensure that it is well represented. This follows since watermarking may put an extra constraint on the system, similar to adding noise. In other words, if noise is added to the positions (e.g., tracks) where the pitch pulse is represented, quality may be degraded. Thus, the systems and methods disclosed herein may attempt to determine where the pitch pulse locations are going to be based on a past history of the pitch parameters. This is done by estimating where the pitch positions are going to be. Then, the watermark data 116 may not be embedded on those corresponding tracks. However, more watermarking data 116 may be placed on other "low priority" tracks.

Once the high priority and low priority tracks have been determined or estimated, the coder circuitry 118 may embed the watermark data 116 from the modeler circuitry 112 onto the low priority track(s). Thus, for example, the coder circuitry 118 may avoid embedding watermark data into a track that is used to represent pitch. The resulting signal (e.g., the "carrier" signal with the embedded watermark data) may be referred to as a watermarked second signal 122 (e.g., bitstream).

It should be noted that the watermarking process may alter some of the bits of an encoded second signal 108. For example, the second signal 108 may be referred to as a "carrier" signal or bitstream. In the watermarking process, some of the bits that make up the encoded second signal 108 may be altered in order to embed or insert the watermark data 116 derived from the first signal 106 into the second signal 108 to produce the watermarked second signal 122. In some cases, this may be a source of degradation in the encoded second signal 108. However, this approach may be advantageous since decoders that are not designed to extract the watermarked information may still recover a version of the second signal 108, without the extra information provided by the first signal 106. Thus, "legacy" devices and infrastructure may still function regardless of the watermarking. This approach further allows other decoders (that are designed to extract the watermarked information) to be used to extract the additional watermark information provided by the first signal 106.

The watermarked second signal 122 (e.g., bitstream) may be provided to the communication interface 124. Examples of the communication interface 124 may include transceivers, network cards, wireless modems, etc. The communication interface 124 may be used to communicate (e.g., transmit) the watermarked second signal 122 to another device, such as electronic device B 134 over a network 128. For example, the communication interface 124 may be based on wired and/or wireless technology. Some operations performed by the communication interface 124 may include modulation, formatting (e.g., packetizing, interleaving, scrambling, etc.), upconversion, amplification, etc. Thus, electronic device A 102 may transmit a signal 126 that comprises the watermarked second signal 122.

The signal 126 (including the watermarked second signal 122) may be sent to one or more network devices 130. For example, a network 128 may include the one or more network devices 130 and/or transmission mediums for communicating signals between devices (e.g., between electronic device A 102 and electronic device B 134). In the configuration illustrated in FIG. 1, the network 128 includes one or more network devices 130. Examples of network devices 130 include base stations, routers, servers, bridges, gateways, etc.

In some cases, one or more network devices 130 may transcode the signal 126 (that includes the watermarked second signal 122). Transcoding may include decoding the transmitted signal 126 and re-encoding it (into another format, for example). In some cases, transcoding the signal 126 may destroy the watermark information embedded in the signal 126. In such a case, electronic device B 134 may receive a signal that no longer contains the watermark information. Other network devices 130 may not use any transcoding. For instance, if a network 128 uses devices that do not transcode signals, the network 128 may provide tandem-free/transcoder-free operation (TFO/TrFO). In this case, the watermark information embedded in the watermarked second signal 122 may be preserved as it is sent to another device (e.g., electronic device B 134).

Electronic device B 134 may receive a signal 132 (via the network 128), such as a signal 132 having watermark information preserved or a signal 132 without watermark information. For instance, electronic device B 134 may receive a signal 132 using a communication interface 136. Examples of the communication interface 136 may include transceivers, network cards, wireless modems, etc. The communication interface 136 may perform operations such as downconversion, synchronization, de-formatting (e.g., de-packetizing, unscrambling, de-interleaving, etc.) and/or channel decoding on the signal 132 to extract a received bitstream 138. The received bitstream 138 (which may or may not be a watermarked bitstream) may be provided to a decoder block/module 140. For example, the received bitstream 138 may be provided to modeler circuitry 142 and to decoder circuitry 150.

The decoder block/module 140 may include modeler circuitry 142, portion determination circuitry 152 and/or decoder circuitry 150. The decoder block/module 140 may optionally include combining circuitry 146. The portion determination circuitry 152 may determine portion information 144 that indicates a (low priority) portion of the received bitstream 138 in which watermark data may be embedded. For example, the decoder circuitry 150 may provide information 148 that the portion determination circuitry 152 may use to determine the location of watermark data in the received bitstream 138. In one configuration, the decoder circuitry 150 provides information 148 from a long term prediction (LTP) filter or pitch filter, which may allow the portion determination circuitry 152 to determine or estimate one or more tracks on which watermark data may be embedded. This determination may be made similarly to the low priority track determination performed by the encoder 110. For example, the portion determination circuitry 152 may determine tracks that have the largest LTP contribution. A number of tracks (e.g., two) may be determined (e.g., designated) as the high priority tracks, while the other tracks may be determined (e.g., designated) as the low priority tracks. In one configuration, an indication of the low priority tracks may be provided to the modeler circuitry 142 as portion information 144.

The portion information 144 may be provided to the modeler circuitry 142. If watermarked information is embedded in the received bitstream 138, the modeler circuitry 142 may use the portion information 144 (e.g., low priority track indication) to extract, model and/or decode the watermark data from the received bitstream 138. For example, the modeler circuitry 142 may extract, model and/or decode watermark data from the received bitstream 138 to produce a decoded first signal 154.

The decoder circuitry 150 may decode the received bitstream 138. In some configurations, the decoder circuitry 150 may use a "legacy" decoder (e.g., a standard narrowband decoder) or decoding procedure that decodes the received bitstream 138 regardless of any watermark information that may be included in the received bitstream 138. The decoder circuitry 150 may produce a decoded second signal 158. Thus, for example, if no watermark information is included in the received bitstream 138, the decoder circuitry 150 may still recover a version of the second signal 108, which is the decoded second signal 158.

In some configurations, the operations performed by the modeler circuitry 142 may depend on operations performed by the decoder circuitry 150. For example, a model (e.g., EVRC-WB) used for a higher frequency band may depend on a decoded narrowband signal (e.g., the decoded second signal 158 decoded using AMR-NB). In this case, the decoded second signal 158 may be provided to the modeler circuitry 142.

In some configurations, a decoded second signal 158 may be combined with a decoded first signal 154 by combining circuitry 146 to produce a combined signal 156. In other configurations, the watermark data from the received bitstream 138 and the received bitstream 138 may be decoded separately to produce the decoded first signal 154 and the decoded second signal 158. Thus, one or more signals B 160 may include a decoded first signal 154 and a separate decoded second signal 158 and/or may include a combined signal 156. It should be noted that the decoded first signal 154 may be a decoded version of the first signal 106 encoded by electronic device A 102. Additionally or alternatively, the decoded second signal 158 may be a decoded version of the second signal 108 encoded by electronic device A 102.

If no watermarked information is embedded in the received signal 132, the decoder circuitry 150 may decode the received bitstream 138 (in a legacy mode, for example) to produce the decoded second signal 158. This may provide a decoded second signal 158, without the additional information provided by the first signal 106. This may occur, for example, if the watermark information (from the first signal 106, for example) is destroyed in a transcoding operation in the network 128.

In some configurations, electronic device B 134 may be incapable of decoding the watermark data embedded in the received bitstream 138. For example, electronic device B 134 may not include modeler circuitry 142 for extracting the embedded watermark data in some configurations. In such a case, electronic device B 134 may simply decode the received bitstream 138 to produce the decoded second signal 158.

It should be noted that one or more of the elements included in electronic device B 134 may be implemented in hardware (e.g., circuitry), software or a combination of both. For instance, one or more of the elements included in electronic device B 134 may be implemented as one or more integrated circuits, application specific integrated circuits (ASICs), etc., and/or using a processor and instructions.

In some configurations, an electronic device (e.g., electronic device A 102, electronic device B 134, etc.) may include both an encoder and a decoder for adaptively encoding and decoding an adaptively encoded watermarked signal. For instance, electronic device A 102 may include both the encoder 110 and a decoder similar to the decoder 140 included in electronic device B 134. In some configurations, both the encoder 110 and a decoder similar to the decoder 140 included in electronic device B 134 may be included in a codec. Thus, a single electronic device may be configured to both produce adaptively encoded watermarked signals and to decode adaptively encoded watermarked signals.

It should be noted that the watermarked second signal 122 may not necessarily be transmitted to another electronic device in some configurations and/or instances. For example, electronic device A 102 may instead store the watermarked second signal 122 for later access (e.g., decoding, playback, etc.).

Figure 2:
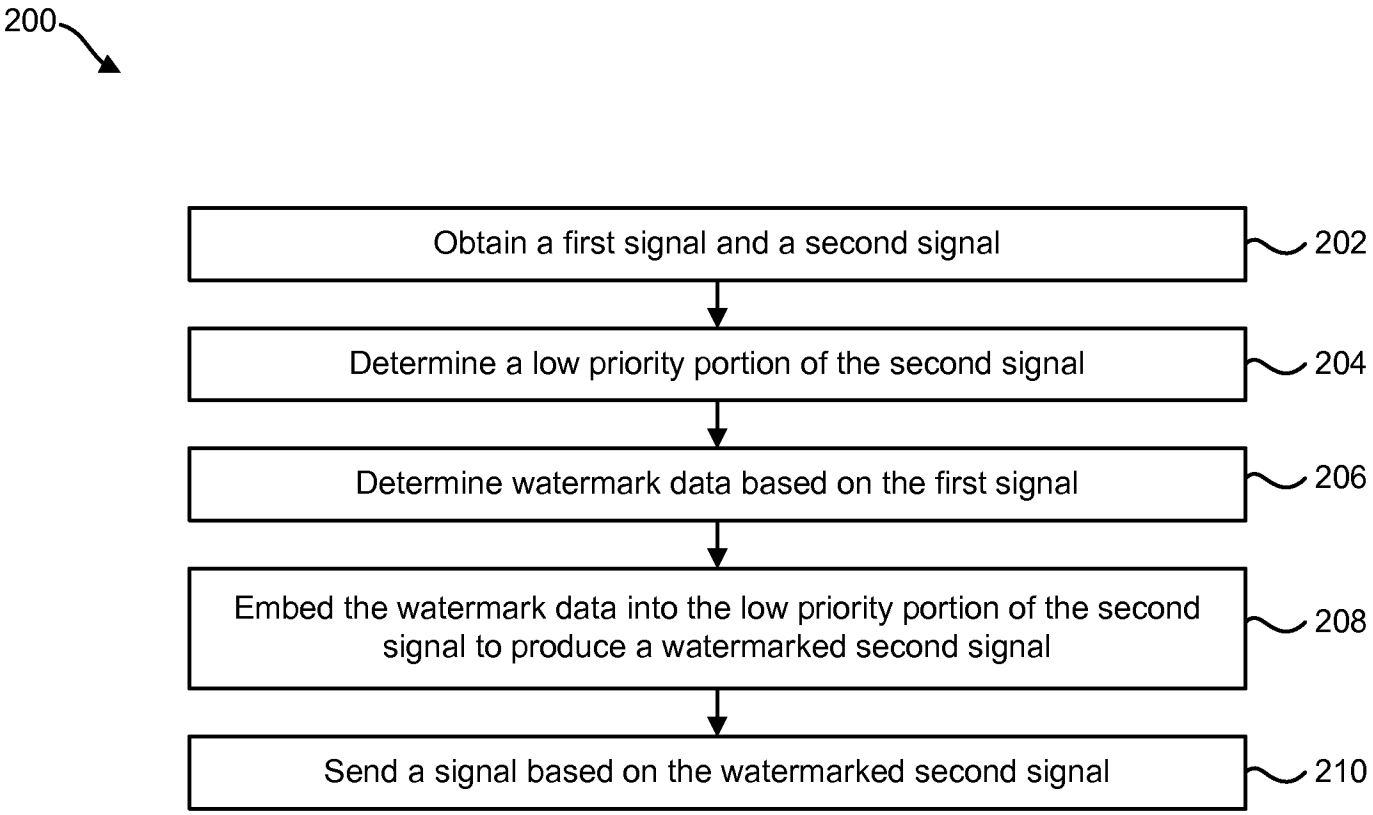
FIG. 2 is a flow diagram illustrating one configuration of a method for adaptively encoding a watermarked signal.

FIG. 2 is a flow diagram illustrating one configuration of a method 200 for adaptively encoding a watermarked signal. An electronic device 102 (e.g., wireless communication device) may obtain 202 a first signal 106 and a second signal 108. For example, the electronic device 102 may capture or receive one or more signals 104. In one configuration, the electronic device 102 may optionally divide a signal 104 into a first signal 106 and a second signal 108. This may be done using an analysis filter bank, for example, when high and low frequency components of a speech signal are to be encoded as a watermarked signal. In such a case, the lower components (e.g., the second signal 108) may be conventionally encoded and the higher components (e.g., the first signal 106) may be embedded as a watermark on the conventionally encoded signal. In other configurations, the electronic device 102 may simply have a separate signal or portion of information to be embedded within a "carrier" signal (e.g., the second signal 108). For instance, the electronic device 102 may obtain 202 a first signal 106 and a second signal 108, where the first signal 106 is to be embedded within the second signal 108 as watermark data 116.

The electronic device 102 may determine 204 a low priority portion of the second signal 108. For example, the electronic device 102 may determine a low priority portion of the second signal 108 that is perceptually less important than another portion of the second signal 108. The low priority portion or perceptually less important portion of the second signal 108 may be a portion that is not used to represent pitch information, for instance.

In one configuration, the electronic device 102 may determine a high priority portion of the second signal 108. This may be done in order to determine 204 the low priority portion of the second signal 108. The high priority portion of the second signal 108 may be a portion that is used to represent pitch information.

In one approach, the high priority portion of the second signal 108 may be indicated by one or more codebook tracks that have a larger long term prediction (LTP) contribution than other codebook tracks. The electronic device 102 may perform linear predictive coding (LPC) and long term prediction (LTP) operations (e.g., pitch filtering) on the second signal 108 to obtain an LTP contribution for each of the codebook tracks.

The electronic device 102 may determine one or more tracks that have a larger or largest LTP contribution. For instance, the electronic device 102 may designate one or more (e.g., two) tracks out of a number of tracks (e.g., five) as high priority tracks that have larger LTP contributions than the remaining (e.g., three) tracks. One or more of the remaining tracks (e.g., three tracks) may be designated as low priority (e.g., less important) tracks. The larger LTP contribution may indicate that a pitch pulse is represented on the high priority tracks.

In one configuration, determining 204 the low priority portion of the second signal 108 may be based on a current signal and/or past signal (e.g., current frame and/or past frame). For example, the electronic device 102 may determine 204 the low priority portion of the second signal 108 based on a current frame of the second signal 108 and one or more past frames of the second signal 108. For instance, the LTP operation may be performed using a current frame and one or more past frames.

In some configurations, a memory-limited LTP contribution may be used to determine the one or more high priority codebook tracks. In other words, the LTP contribution may be replaced by a memory-limited LTP contribution. A limited memory version of the LTP can be constructed based only on the quantized pitch values and codebook contributions of a last N frames plus the current frame. Gains may be set to unity. For example, with N=2, encoder performance under errors may be greatly improved. The memory-limited LTP contribution may be used since the actual or regular LTP signal may be very sensitive to channel errors (because it has an infinite propagation time of errors). Thus, a modified or memory-limited LPC may be used by zeroing out the memory after a certain number of frames.

The electronic device 102 may determine 206 watermark data 116 based on the first signal 106. In one example, one or more unmodified bits from the first signal 106 may be designated (e.g., determined 206) as watermark data 116. In another example, the electronic device 102 may encode or model the first signal 106 in order to produce the watermark data 116 (e.g., bits). For instance, the first signal 106 may be encoded to produce watermark data 116. In general, watermark data 116 may be information or a signal that is to be embedded on a second signal 108 (e.g., encoded second signal 108). In some configurations, the watermark data 116 may be determined based on data 114 from the coder circuitry 118. This may be the case, for example, when the first signal 106 comprises a higher frequency component to be modeled based on a coded lower frequency component (e.g., data 114 determined based on the second signal 108).

The electronic device 102 may embed 208 the watermark data 116 into the low priority portion of the second signal 108 to produce a watermarked second signal 122. For example, the electronic device 102 may embed 208 the watermark data 116 on one or more codebook tracks (used to encode the second signal 108) that are low priority codebook tracks. For instance, watermark bits may be embedded by restricting the number of allowed pulse combinations on the low priority tracks. In the case of AMR-NB, where there are two pulses per track, for example, the pulse positions may be constrained so that an exclusive OR (XOR) of the two pulse positions on a low priority track are equal to the watermark to transmit.

In some configurations, the size of the watermark may also be varied based on the determination of high priority and/or low priority tracks. For example, the watermark may be larger on the low priority tracks depending on the number of high priority tracks and the track capacity for watermarking. For instance, if a track has a watermarking capacity of two bits and three low priority tracks are available, then six watermark bits may be distributed evenly across the low priority tracks. However, if four low priority tracks are available, then a greater number of watermark bits may be embedded into lowest priority tracks. For instance, two watermarking bits could be embedded on each of the two lowest LTP contribution low priority tracks, while one bit each could be embedded on the other two low priority tracks. Additionally or alternatively, the number of bits allowed to be watermarked may depend on the number of available low priority tracks and their watermarking capacity. Similar schemes may be used on a decoder to extract various watermarking sizes.

The electronic device 102 may send 210 a signal based on the watermarked second signal 122. For example, the electronic device 102 may transmit a signal comprising the watermarked second signal 122 to another device 134 via a network 128.

Figure 3:
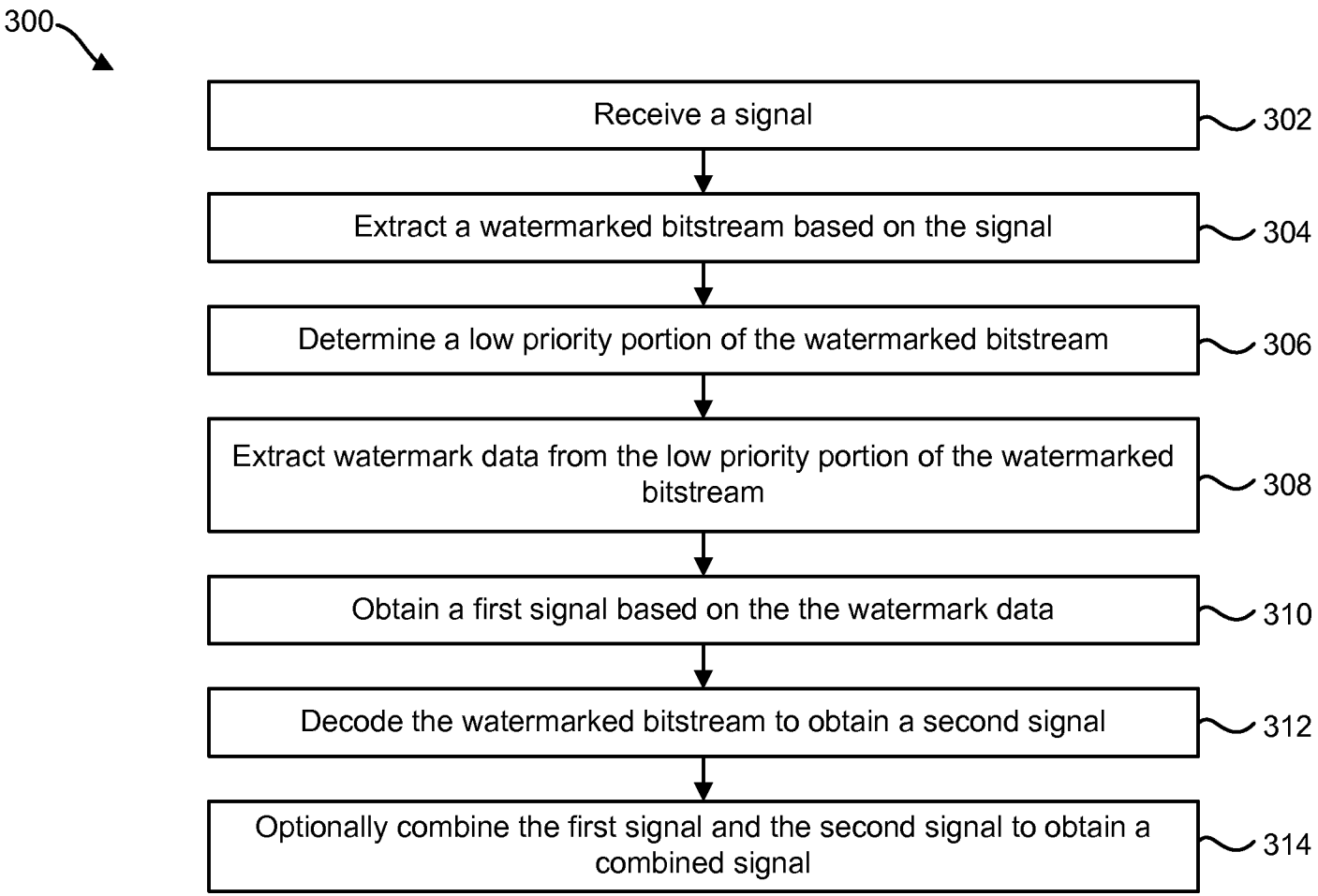
FIG. 3 is a flow diagram illustrating one configuration of a method for decoding an adaptively encoded watermarked signal.

FIG. 3 is a flow diagram illustrating one configuration of a method 300 for decoding an adaptively encoded watermarked signal. An electronic device 134 may receive 302 a signal 132. The signal 132 may comprise a watermarked second signal 122, for example. In some configurations, an electronic device 134 may receive 302 an electromagnetic signal using a wireless and/or a wired connection.

The electronic device 134 may extract 304 a watermarked bitstream (e.g., received bitstream 138) based on the signal 132. For example, the electronic device 134 may downconvert, demodulate, amplify, synchronize, de-format and/or channel decode the signal 132 in order to obtain a watermarked bitstream (e.g., received bitstream 138).

The electronic device 134 may determine 306 a low priority portion of the watermarked bitstream. For example, the low priority portion may be a portion of the watermarked bitstream that includes perceptually less important information than another portion of the watermarked bitstream. For instance, the low priority portion may not include information that represents pitch. This determination 306 may be based on a current frame and/or a past frame. In one configuration, this low priority portion does not include high priority codebook tracks. For instance, the electronic device 134 may determine one or more high priority codebook tracks based on the watermarked bitstream. Determining 306 the low priority portion may be based on determining the one or more high priority codebook tracks based on the watermarked bitstream. For example, the low priority portion may be determined 306 or designated as one or more codebook tracks that are not high priority codebook tracks. In one configuration, the electronic device 134 may obtain an LTP or pitch filter output. The electronic device 134 may examine the LTP or pitch filter output to determine one or more codebook tracks that have a larger or largest LTP contribution. In one configuration, the electronic device 134 may determine the two tracks with the largest LTP contribution to be high priority codebook tracks, while the remaining (e.g., three) codebook tracks may be deemed low priority codebook tracks.

In some configurations, a memory-limited LTP contribution may be used to determine the one or more high priority codebook tracks. In other words, a memory-limited LTP contribution may be alternatively used instead of the LTP contribution. A limited memory version of the LTP can be constructed based only on the quantized pitch values and codebook contributions of a last N frames plus the current frame. Gains may be set to unity. For example, with N=2, performance under errors may be greatly improved. The memory-limited LTP contribution may be alternatively used since an actual or regular LTP signal may be very sensitive to channel errors (because it has an infinite propagation time of errors). Thus, a modified or memory-limited LPC may be used by zeroing out the memory after a certain number of frames. It should be noted that determining 306 a low priority portion of the watermarked bitstream may be accomplished similarly to determining 204 a low priority portion of the second signal as described in connection with FIG. 2 in some configurations.

The electronic device 134 may extract 308 watermark data from the low priority portion of the watermarked bitstream (e.g., received bitstream 138). In one configuration, the electronic device 134 may extract 308 watermark data from the watermarked bitstream based on the one or more high priority codebook tracks. For example, the electronic device 134 may extract watermark data only from codebook tracks that are not high priority codebook tracks (but that are low priority codebook tracks, for instance).

The electronic device 134 may obtain 310 a first signal (e.g., a decoded first signal 154) based on the watermark data. In one configuration, for example, the electronic device 134 may model the watermark data using an EVRC-WB model to obtain the first signal (e.g., high-band data). Additionally or alternatively, the electronic device 134 may obtain 310 the first signal by decoding the watermark data. Alternatively, the first signal may comprise the watermark data. In some configurations, the electronic device 134 may obtain 310 the first signal based on a second signal (e.g., decoded second signal 158). For example, a model (e.g., EVRC-WB) used for a higher frequency band may depend on a decoded second signal 158 (decoded using AMR-NB, for example). In this case, the electronic device 134 may use the decoded second signal 158 to model or decode the watermark data to obtain 310 the first signal (e.g., decoded first signal 154).

The electronic device 134 may decode 312 the watermarked bitstream to obtain a second signal (e.g., decoded second signal 158). For example, the electronic device 134 may use a decoder (e.g., decoder circuitry 150) to decode 312 the watermarked bitstream to obtain the second signal. In one configuration, the electronic device 134 may use a conventional (e.g., "legacy") AMR-NB decoder to obtain the second signal (e.g., narrowband data). As described above, the second signal (e.g., decoded second signal 158) may be used to obtain 310 the first signal (e.g., decoded first signal 154) in some configurations.

In some configurations, the electronic device 134 may optionally combine 314 the first signal (e.g., decoded first signal 154) and the second signal (e.g., decoded second signal 158) to obtain a combined signal 156. For example, the electronic device 134 may combine a first signal comprising high-band data and a second signal comprising low-band or narrowband data using a synthesis filter bank. In other configurations, the electronic device 134 may not combine the first signal and the second signal.

Figure 4:
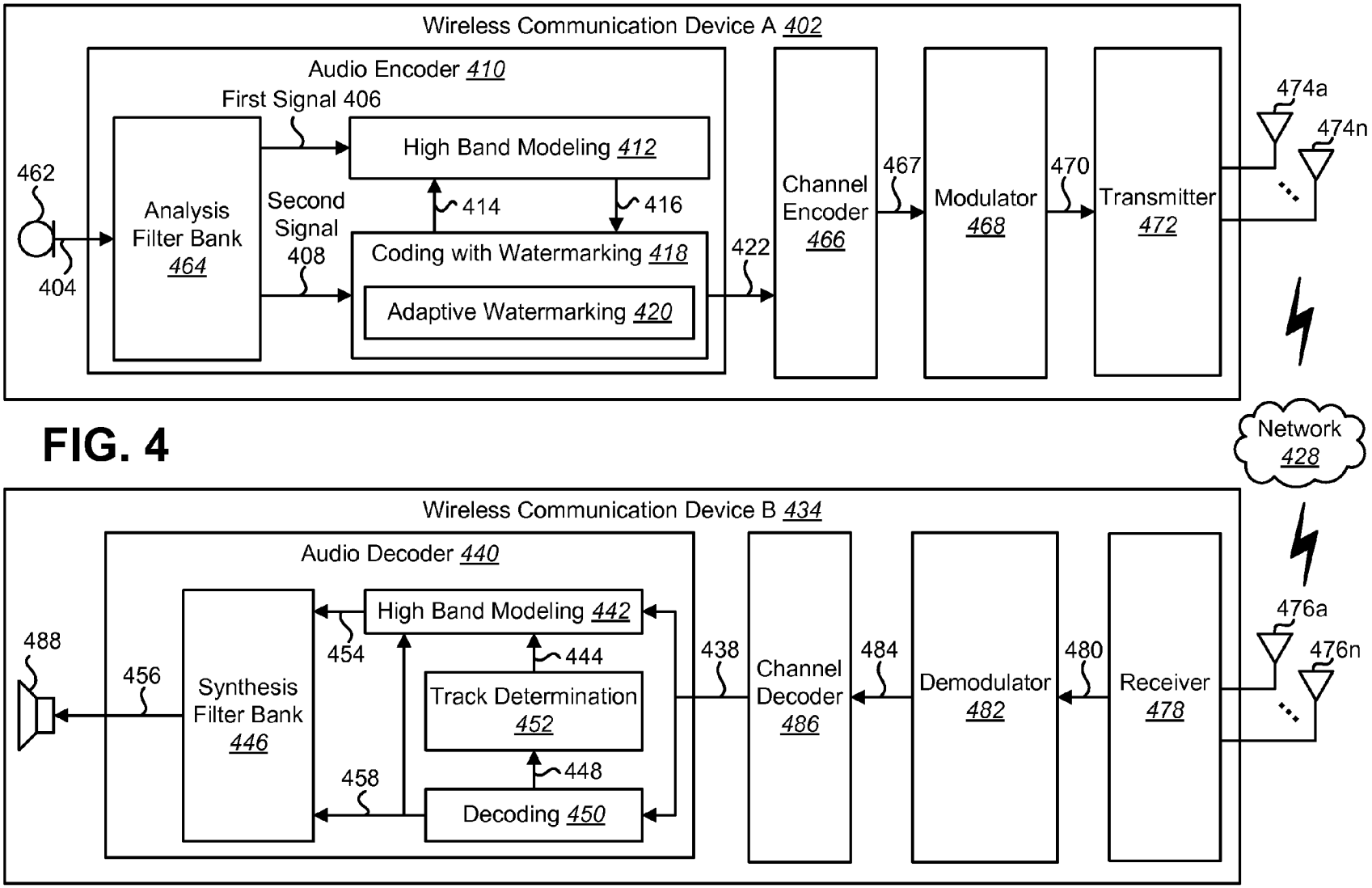
FIG. 4 is a block diagram illustrating one configuration of wireless communication devices in which systems and methods for adaptively encoding and decoding a watermarked signal may be implemented.

FIG. 4 is a block diagram illustrating one configuration of wireless communication devices 402, 434 in which systems and methods for adaptively encoding and decoding a watermarked signal may be implemented. Examples of wireless communication device A 402 and wireless communication device B 434 may include cellular phones, smart phones, personal digital assistants (PDAs), laptop computers, e-readers, etc.

Wireless communication device A 402 may include a microphone 462, an audio encoder 410, a channel encoder 466, a modulator 468, a transmitter 472 and one or more antennas 474*a-n*. The audio encoder 410 may be used for encoding and watermarking audio. The channel encoder 466, modulator 468, transmitter 472 and one or more antennas 474*a-n* may be used to prepare and transmit one or more signals to another device (e.g., wireless communication device B 434).

Wireless communication device A 402 may obtain an audio signal 404. For example, wireless communication device A 402 may capture the audio signal 404 (e.g., speech) using a microphone 462. The microphone 462 may convert an acoustic signal (e.g., sounds, speech, etc.) into the electrical or electronic audio signal 404. The audio signal 404 may be provided to the audio encoder 410, which may include an analysis filter bank 464, a high-band modeling block/module 412 and a coding with watermarking block/module 418.

The audio signal 404 may be provided to the analysis filter bank 464. The analysis filter bank 464 may divide the audio signal 404 into a first signal 406 and a second signal 408. For example, the first signal 406 may be a higher frequency component signal and the second signal 408 may be a lower frequency component signal. The first signal 406 may be provided to the high-band modeling block/module 412. The second signal 408 may be provided to the coding with watermarking block/module 418.

It should be noted that one or more of the elements (e.g., microphone 462, audio encoder 410, channel encoder 466, modulator 468, transmitter 472, etc.) included in wireless communication device A 402 may be implemented in hardware, software or a combination of both. For instance, one or more of the elements included in wireless communication device A 402 may be implemented as one or more integrated circuits, application specific integrated circuits (ASICs), etc., and/or using a processor and instructions. It should also be noted that the term "block/module" may also be used to indicate that an element may be implemented in hardware, software or a combination of both.

The coding with watermarking block/module 418 may perform coding on the second signal 408. For example, the coding with watermarking block/module 418 may perform adaptive multi-rate (AMR) coding on the second signal 408. The high-band modeling block/module 412 may determine watermark data 416 that may be embedded into the second signal (e.g., "carrier" signal) 408. For example, the coding with watermarking block/module 418 may produce a coded bitstream that watermark bits may be embedded into. The coded second signal 408 with the embedded watermark data 416 may be referred to as a watermarked second signal 422.

The coding with watermarking block/module 418 may code (e.g., encode) the second signal 408. In some configurations, this coding may produce data 414, which may be provided to the high-band modeling block/module 412. In one configuration, the high-band modeling block/module 412 may use an EVRC-WB model to model higher frequency components (from the first signal 406) that relies on lower frequency components (from the second signal 408) that may be encoded by the coding with watermarking block/module 418. Thus, the data 414 may be provided to the high-band modeling block/module 412 for use in modeling the higher frequency components. The resulting higher frequency component watermark data 416 may then be embedded into the second signal 408 by the coding with watermarking block/module 418, thereby producing the watermarked second signal 422. Embedding the watermark data 416 (e.g., high-band bits) may involve the use of a watermarking codebook (e.g., fixed codebook or FCB) to embed the watermark data 416 into the second signal 408 to produce the watermarked second signal 422 (e.g., a watermarked bitstream).

The coding with watermarking block/module 418 may include an adaptive watermarking block/module 420. The adaptive watermarking block/module 420 may determine a low priority portion of the second signal 408 and embed the watermark data 416 (e.g., high-band bits) into the low priority portion of the second signal. One example of the coding with watermarking block/module 418 is an algebraic code excited linear prediction (ACELP) coder. In this example, the coding with watermarking block/module 418 may use a codebook (e.g., fixed codebook (FCB)) in order to encode the second signal 408. The codebook may use a number of tracks in the encoding process. For example, AMR-NB coding uses five tracks of eight positions for a 40-sample sub-frame. The adaptive watermarking block/module 420 may use the second signal 408 to determine one or more high priority tracks. For example, high priority tracks may be tracks on which a pitch pulse is represented. In one configuration, the adaptive watermarking block/module 420 may make this determination based on a long term prediction (LTP) filter (or pitch filter) contribution. For example, the adaptive watermarking block/module 420 may examine the LTP filter output to determine the largest LTP contribution for a designated number of tracks. For instance, the largest energy in the LTP filter output may be found, taking a largest maximum for each track. In one configuration, the two tracks with the largest LTP contributions may be designated "high priority tracks" or important tracks. One or more remaining tracks may be designated as "low priority tracks" or less important tracks.

This approach may be used since all tracks may not have the same impact on speech quality. For example, it may be important in speech coding to properly represent the main pitch pulse. Accordingly, if there is a pitch pulse in a subframe, the systems and methods disclosed herein may ensure that it is well represented. This follows since watermarking may put an extra constraint on the system, similar to adding noise. In other words, if noise is added to the positions (e.g., tracks) where the pitch pulse is represented, quality may be degraded. Thus, the systems and methods disclosed herein may attempt to determine where the pitch pulse locations are going to be based on a past history of the pitch parameters. This is done by estimating where the pitch positions are going to be. Then, the watermark data 416 may not be embedded on those corresponding tracks. However, more watermarking data 416 may be placed on other "low priority" tracks.

Once the high priority and low priority tracks have been determined or estimated, the coding with watermarking block/module 418 may embed the watermark data 416 (e.g., high band bits) from the high band modeling block/module 412 onto the low priority track(s). Thus, for example, the coding with watermarking block/module 418 may avoid embedding watermark data into a track that is used to represent pitch. The resulting signal (e.g., the "carrier" signal with the embedded watermark data 416) may be referred to as a watermarked second signal 422 (e.g., bitstream).

It should be noted that the watermarking process may alter some of the bits of an encoded second signal 408. For example, the second signal 408 may be referred to as a "carrier" signal or bitstream. In the watermarking process, some of the bits that make up the encoded second signal 408 may be altered in order to embed or insert the watermark data 416 derived from the first signal 406 into the second signal 408 to produce the watermarked second signal 422. In some cases, this may be a source of degradation in the encoded second signal 408. However, this approach may be advantageous since decoders that are not designed to extract the watermarked information may still recover a version of the second signal 408, without the extra information provided by the first signal 406. Thus, "legacy" devices and infrastructure may still function regardless of the watermarking. This approach further allows other decoders (that are designed to extract the watermarked information) to be used to extract the additional watermark information provided by the first signal 406.

The watermarked second signal 422 (e.g., bitstream) may be provided to the channel encoder 466. The channel encoder 466 may encode the watermarked second signal 422 to produce a channel-encoded signal 467. For example, the channel encoder 466 may add error detection coding (e.g., a cyclic redundancy check (CRC)) and/or error correction coding (e.g., forward error correction (FEC) coding) to the watermarked second signal 422.

The channel-encoded signal 467 may be provided to the modulator 468. The modulator 468 may modulate the channel-encoded signal 467 to produce a modulated signal 470. For example, the modulator 468 may map bits in the channel-encoded signal 467 to constellation points. For instance, the modulator 468 may apply a modulation scheme to the channel-encoded signal 467 such as binary phase-shift keying (BPSK), quadrature amplitude modulation (QAM), frequency-shift keying (FSK), etc., to produce the modulated signal 470.

The modulated signal 470 may be provided to the transmitter 472. The transmitter 472 may transmit the modulated signal 470 using the one or more antennas 474*a-n*. For example, the transmitter 472 may upconvert, amplify and transmit the modulated signal 470 using the one or more antennas 474*a-n*.

The modulated signal 470 that includes the watermarked second signal 422 (e.g., a "transmitted signal") may be transmitted from wireless communication device A 402 to another device (e.g., wireless communication device B 434) over a network 428. The network 428 may include the one or more network 428 devices and/or transmission mediums for communicating signals between devices (e.g., between wireless communication device A 402 and wireless communication device B 434). For example, the network 428 may include one or more base stations, routers, servers, bridges, gateways, etc.

In some cases, one or more network 428 devices may transcode the transmitted signal (that includes the watermarked second signal 422). Transcoding may include decoding the transmitted signal and re-encoding it (into another format, for example). In some cases, transcoding may destroy the watermark information embedded in the transmitted signal. In such a case, wireless communication device B 434 may receive a signal that no longer contains the watermark information. Other network 428 devices may not use any transcoding. For instance, if a network 428 uses devices that do not transcode signals, the network may provide tandem-free/transcoder-free operation (TFO/TrFO). In this case, the watermark information embedded in the watermarked second signal 422 may be preserved as it is sent to another device (e.g., wireless communication device B 434).

Wireless communication device B 434 may receive a signal (via the network 428), such as a signal having watermark information preserved or a signal without watermark information. For instance, wireless communication device B 434 may receive a signal using one or more antennas 476*a-n* and a receiver 478. In one configuration, the receiver 478 may downconvert and digitize the signal to produce a received signal 480.

The received signal 480 may be provided to a demodulator 482. The demodulator 482 may demodulate the received signal 480 to produce a demodulated signal 484, which may be provided to a channel decoder 486. The channel decoder 486 may decode the signal (e.g., detect and/or correct errors using error detection and/or correction codes) to produce a (decoded) received bitstream 438.

The received bitstream 438 may be provided to an audio decoder 440. For example, the received bitstream 438 may be provided to a high-band modeling block/module 442 and to a decoding block/module 450.

The audio decoder 440 may include a high band modeling block/module 442, a track determination block/module 452 and/or a decoding block/module 450. The audio decoder 440 may optionally include a synthesis filter bank 446. The track determination block/module 452 may determine track information 444 that indicates one or more tracks of the received bitstream 438 in which watermark data may be embedded. For example, the decoding block/module 450 may provide information 448 that the track determination block/module 452 may use to determine the location of watermark data in the received bitstream 438. In one configuration, the decoding block/module 450 provides information 448 from a long term prediction (LTP) filter or pitch filter, which may allow the track determination block/module 452 to determine or estimate one or more tracks on which watermark data may be embedded. This determination may be made similarly to the low priority track determination performed by the audio encoder 410. For example, the track determination block/module 452 may determine one or more tracks that have the largest LTP contribution(s). A number of tracks (e.g., two) may be determined (e.g., designated) as the high priority tracks, while the other tracks may be determined (e.g., designated) as the low priority tracks. In one configuration, an indication of the low priority tracks may be provided to the high band modeling block/module 442 as track information 444.

The track information 444 may be provided to the high band modeling block/module 442. If watermarked information is embedded in the received bitstream 438, the high band modeling block/module 442 may use the track information 444 (e.g., low priority track indication) to model and/or decode the watermark data from the received bitstream 438. For example, the modeling/decoding block/module may extract, model and/or decode watermark data from the received bitstream 438 to produce a decoded first signal 454.

The decoding block/module 450 may decode the received bitstream 438. In some configurations, the decoding block/module 450 may use a "legacy" decoder (e.g., a standard narrowband decoder) or decoding procedure that decodes the received bitstream 438 regardless of any watermark information that may be included in the received bitstream 438. The decoding block/module 450 may produce a decoded second signal 458. Thus, for example, if no watermark information is included in the received bitstream 438, the decoding block/module 450 may still recover a version of the second signal 408, which is the decoded second signal 458.

In some configurations, the operations performed by the high band modeling block/module 442 may depend on operations performed by the decoding block/module 450. For example, a model (e.g., EVRC-WB) used for a higher frequency band may depend on a decoded narrowband signal (e.g., the decoded second signal 458 decoded using AMR-NB). In this case, the decoded second signal 458 may be provided to the high band modeling block/module 442.

In some configurations, a decoded second signal 458 may be combined with a decoded first signal 454 by a synthesis filter bank 446 to produce a combined signal 456. For example, the decoded first signal 454 may include higher frequency audio information, while the decoded second signal 458 may include lower frequency audio information. It should be noted that the decoded first signal 454 may be a decoded version of the first signal 406 encoded by wireless communication device A 402. Additionally or alternatively, the decoded second signal 458 may be a decoded version of the second signal 408 encoded by wireless communication device A 402. The synthesis filter bank 446 may combine the decoded first signal 454 and the decoded second signal 458 to produce the combined signal 456, which may be a wide-band audio signal.

The combined signal 456 may be provided to a speaker 488. The speaker 488 may be a transducer that converts electrical or electronic signals into acoustic signals. For instance, the speaker 488 may convert an electronic wide-band audio signal (e.g., the combined signal 456) into an acoustic wide-band audio signal.

If no watermarked information is embedded in the received bitstream 438, the audio decoding block/module 450 may decode the received bitstream 438 (in a legacy mode, for example) to produce the decoded second signal 458. In this case, the synthesis filter bank 446 may be bypassed to provide the decoded second signal 458, without the additional information provided by the first signal 406. This may occur, for example, if the watermark information (from the first signal 406, for example) is destroyed in a transcoding operation in the network 428.

It should be noted that one or more of the elements (e.g., speaker 488, audio decoder 440, channel decoder 486, demodulator 482, receiver 478, etc.) included in wireless communication device B 434 may be implemented in hardware, software or a combination of both. For instance, one or more of the elements included in wireless communication device B 434 may be implemented as one or more integrated circuits, application specific integrated circuits (ASICs), etc., and/or using a processor and instructions.

Figure 5:
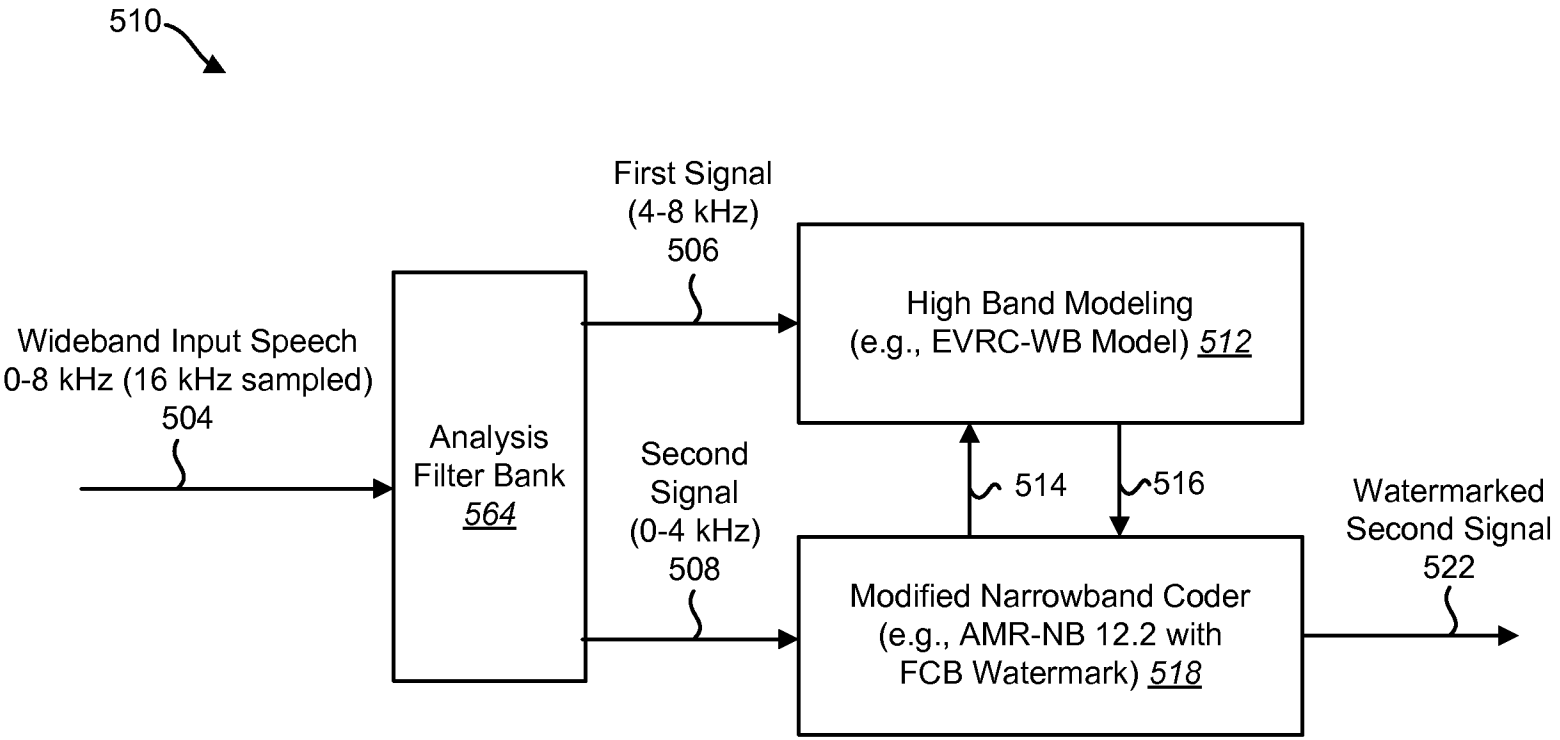
FIG. 5 is a block diagram illustrating one example of a watermarking encoder in accordance with the systems and methods disclosed herein.

FIG. 5 is a block diagram illustrating one example of a watermarking encoder 510 in accordance with the systems and methods disclosed herein. In this example, the encoder 510 may obtain a wideband (WB) speech signal 504, ranging from 0 to 8 kilohertz (kHz). The wideband speech signal 504 may be provided to an analysis filter bank 564 that divides the signal 504 into a first signal 506 or higher frequency component (e.g., 4-8 kHz) and a second signal 508 or lower frequency component (e.g., 0-4 kHz).

The second signal 508 or lower frequency component (e.g., 0-4 kHz) may be provided to a modified narrowband coder 518. In one example, the modified narrowband coder 518 may code the second signal 508 using AMR-NB 12.2 with a FCB watermark. The modified narrowband coder 518 may provide data 514 (e.g., a coded excitation) to the high band modeling block/module 512 in one configuration.

The first signal 506 or higher frequency component may be provided to the high-band modeling block/module 512 (that uses an EVRC-WB model, for example). The high-band modeling block/module 512 may encode or model the first signal 506 (e.g., higher frequency component). In some configurations, the high-band modeling block/module 512 may encode or model the first signal 506 based on the data 514 (e.g., a coded excitation) provided by the modified narrowband coder 518. The encoding or modeling performed by the high-band modeling block/module 512 may produce watermark data 516 (e.g., high-band bits) that are provided to the modified narrowband coder 518.

The modified narrowband coder 518 may embed the watermark data 516 (e.g., high-band bits) as a watermark on the second signal 508. The modified narrowband coder 518 may adaptively encode a watermarked second signal 522. For example, the modified narrowband coder 518 may embed the watermark data 516 into a low priority portion (e.g., low priority tracks) of the second signal 508 as described above. It should be noted that the watermarked second signal 522 (e.g., bitstream) may be decodable by a standard (e.g., conventional) decoder, such as standard AMR. However, if a decoder does not include watermark decoding functionality, it may only be able to decode a version of the second signal 508 (e.g., a lower frequency component).

Figure 6:
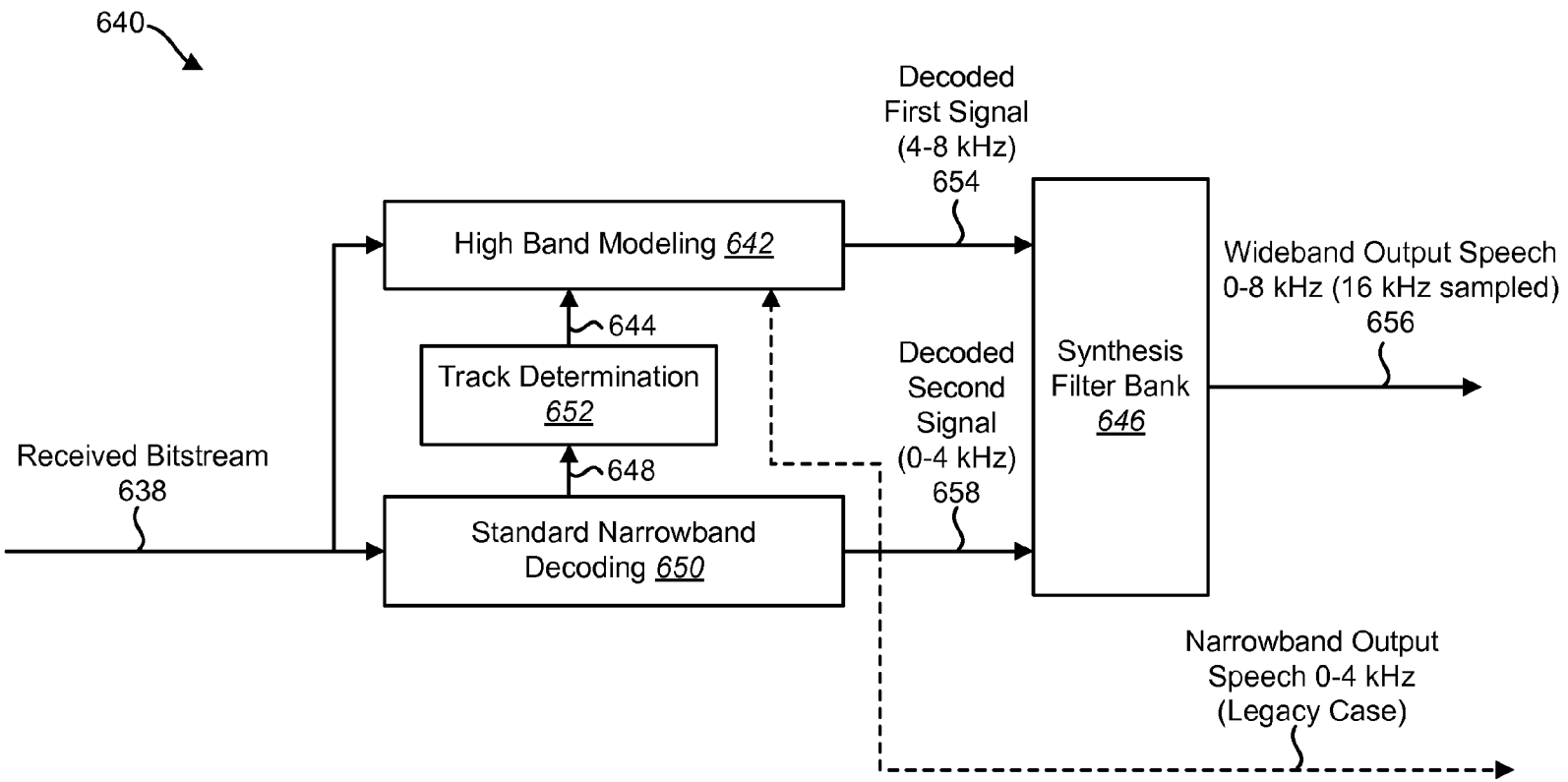
FIG. 6 is a block diagram illustrating one example of a watermarking decoder in accordance with the systems and methods disclosed herein.

FIG. 6 is a block diagram illustrating one example of a watermarking decoder 640 in accordance with the systems and methods disclosed herein. The watermarking decoder 640 may obtain a received bitstream 638 (e.g., a watermarked second signal). The received bitstream 638 may be decoded by the standard narrowband decoding block/module 650 to obtain a decoded second signal 658 (e.g., a lower frequency (e.g., 0-4 kHz) component signal). The decoded lower frequency component signal 658 may be provided to a high-band modeling block/module 642 (e.g., modeler/decoder) in some configurations.

The standard narrowband decoding block/module 650 may provide information 648 to a track determination block/module 652. In one configuration, the information 648 may be provided from an LTP filter or pitch filter as described above in connection with information 148 or information 448. The track determination block/module 652 may determine one or low priority tracks and provide portion or track information 644 to a high band modeling block/module 642 as described above.

The high-band modeling block/module 642 may extract and/or model watermark information embedded in the received bitstream 638 (using the track information 644 and/or the decoded second signal 658) to obtain a decoded first signal 654 (e.g., a higher frequency component signal ranging from 4-8 kHz). The track information 644 may indicate which tracks of the received bitstream 638 contain watermark data. The decoded first signal 654 and the decoded second signal 658 may be combined by a synthesis filter bank 646 to obtain a wideband (e.g., 0-8 kHz, 16 kHz sampled) output speech signal 656. However, in a "legacy" case or a case that the received bitstream 638 does not contain the watermark data, the watermarking decoder 640 may produce a narrowband (e.g., 0-4 kHz) speech output signal (e.g., the decoded second signal 658).

Figure 7:
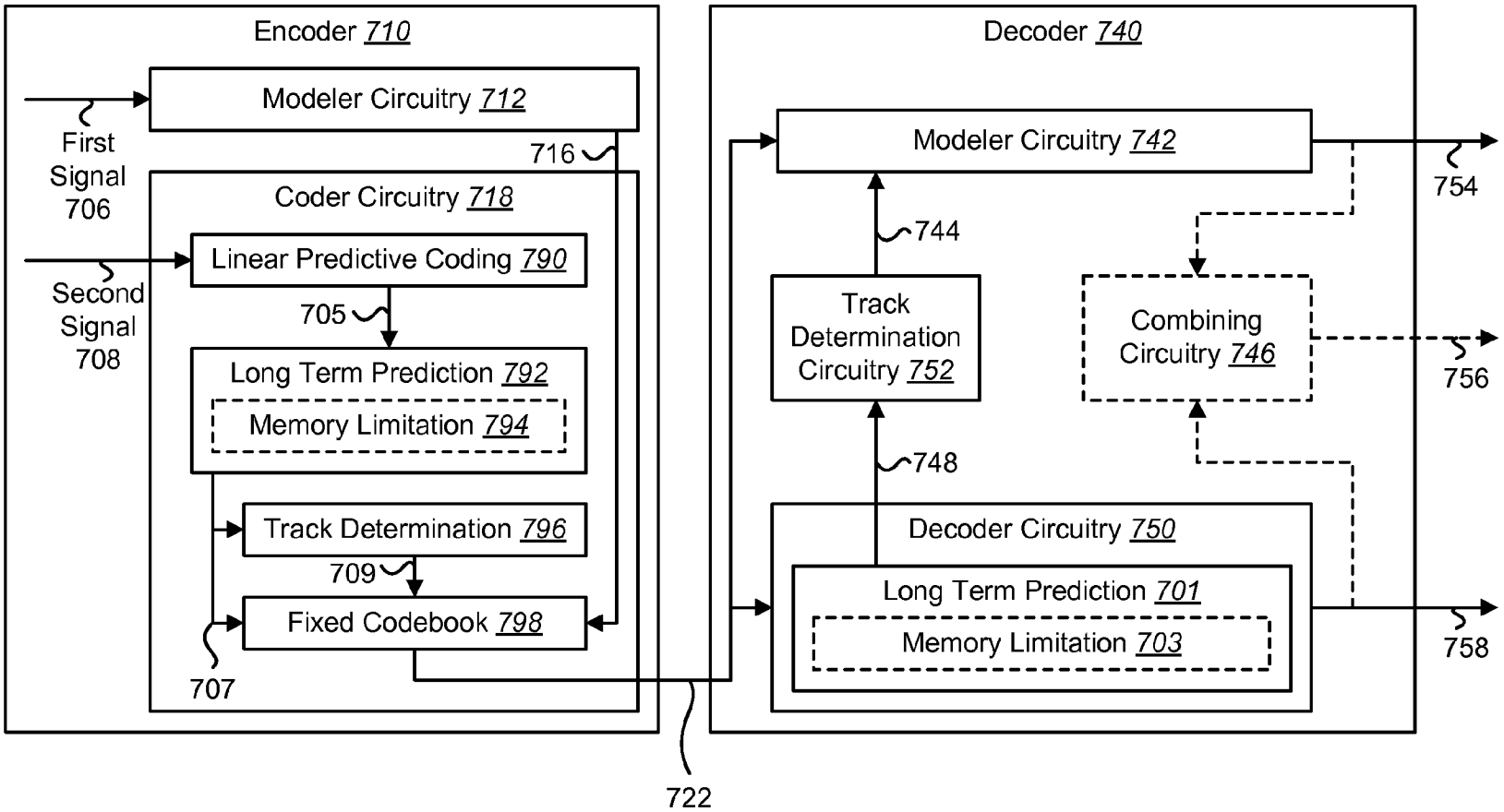
FIG. 7 is a block diagram illustrating examples of an encoder and a decoder that may be implemented in accordance with the systems and methods disclosed herein.

FIG. 7 is a block diagram illustrating examples of an encoder 710 and a decoder 740 that may be implemented in accordance with the systems and methods disclosed herein. The encoder 710 may obtain a first signal 706 and a second signal 708. Examples of the first signal 706 and second signal 708 include two components of a wideband speech signal, a monophonic speech signal and a stereo component signal and unrelated signals. The first signal 706 may be provided to modeler circuitry 712 on the encoder 710 that models and/or encodes the first signal 706 into watermark data 716.

The second signal 708 is provided to coder circuitry 718. The coder circuitry 718 may include a linear predictive coding (LPC) block/module 790, a long term prediction (LTP) block/module 792, a track determination block/module 796 and a fixed codebook (FCB) block/module 798. In some configurations, the linear predictive coding (LPC) block/module 790 and the long term prediction block/module 792 may perform operations similar to those in a traditional code excited linear prediction (CELP) or algebraic code excited linear prediction (ACELP) coder. The LPC block/module 790 may perform an LPC operation on the second signal 708.

The LPC block/module 790 output 705 is provided to the LTP block/module 792 (e.g., pitch filter) that performs an LTP operation on the LPC block/module 790 output 705. The LTP block/module 792 output 707 is provided to the track determination block/module 796 and the FCB block/module 798. It should be noted that an original LTP may be used for low band coding. In some configurations, the memory-limited LTP may be used solely for determining the priority of the tracks for watermarking purposes. The track determination block/module may use an LTP contribution (indicated by the LTP output 707, for example) to determine high priority tracks in order to determine low priority tracks for the FCB block/module 798. For example, the track determination block/module 796 may estimate or attempt to determine high priority tracks that are used to represent pitch in the second signal 708. The track determination block/module 796 output 709 is provided to the FCB block/module 798, which encodes the second signal 708 and embeds the watermark data 716 from the modeler circuitry 712 into low priority tracks indicated by the track determination block/module 796 output 709. This configuration or approach may have a disadvantage in that the LTP signal is sensitive to errors and packet losses and errors may propagate indefinitely. This can lead to the encoder 710 and decoder 740 being out of sync for long periods after an erasure or bit errors.

In another configuration, LTP block/module 792 may use a memory limitation 794. In other words, a memory-limited LTP contribution may be used instead of an LTP contribution. A limited memory version of the LTP can be constructed based only on the quantized pitch values and codebook contributions of a last N frames plus the current frame. Gains may be set to unity. For example, with N=2, encoder 710 performance under errors may be greatly improved. More specifically, the track determination block/module 796 may instead use a memory-limited LTP contribution from the LTP block/module 792 to determine high priority and/or low priority tracks.

The FCB block/module 798 may encode the second signal 708 and embed the watermark data 716 into the second signal 708 to produce a watermarked second signal 722. The watermarked second signal 722 may be sent, transmitted to and/or provided to a decoder 740. Sending the watermarked bitstream may or may not involve channel coding, formatting, transmission over a wireless channel, de-formatting, channel decoding, etc.

The decoder 740 may receive the watermarked second signal 722, which may be provided to modeler circuitry 742 and/or decoder circuitry 750. The decoder circuitry 750 may include a long term prediction (LTP) block/module 701. The LTP block/module 701 may provide information 748 (e.g., LTP contribution(s)) to the track determination circuitry 752 based on the watermarked second signal 722. In some configurations, the LTP block/module 701 may include a memory limitation 703. For example, the information 748 provided to the track determination circuitry 752 may comprise an LTP contribution or a memory-limited LTP contribution. The regular LTP contribution indicator may have the drawback described above (e.g., errors may propagate infinitely). However, the memory-limited LTP contribution may be used for better performance, particularly when erasures or bit errors have occurred.

The track determination circuitry 752 on the decoder 740 may use the information 748 (e.g., LTP contribution(s)) to determine high priority and/or low priority tracks. For example, the track determination circuitry 752 may use one or more LTP contributions or one or more memory-limited LTP contributions to determine one or more high priority and/or low priority tracks as described above. The track determination circuitry 752 may provide track information 744 to the modeler circuitry 742 that indicates one or more tracks of the watermarked second signal 722 that may include watermark data. The modeler circuitry 742 may use the track information 744 to extract, decode and/or model embedded watermark data. For example, the modeler circuitry 742 may obtain watermark data from low priority (codebook) tracks.

The decoder circuitry 750 may produce a decoded second signal 758, while the modeler circuitry 742 may produce a decoded first signal 754. In some configurations, the decoded first signal 754 and the decoded second signal 758 may be combined by combining circuitry 746 to produce a combined signal 756. For example, the decoded first signal 754 may be a higher frequency component signal and the decoded second signal 758 may be a lower frequency component signal that are combined by a synthesis filter bank to produce the combined signal 756 (e.g., a decoded wideband speech signal).

Figure 8:
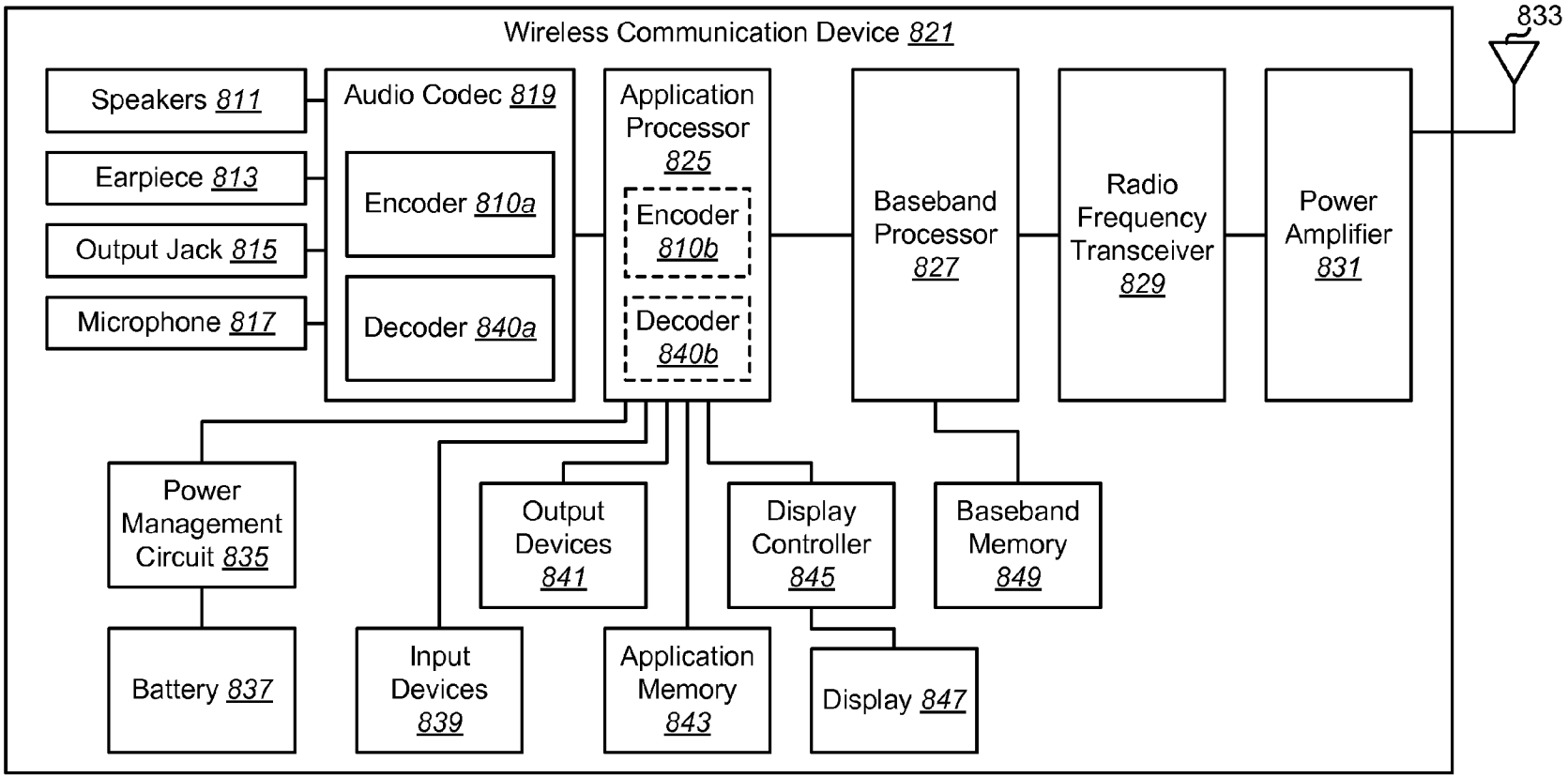
FIG. 8 is a block diagram illustrating one configuration of a wireless communication device in which systems and methods for adaptively encoding and decoding a watermarked signal may be implemented.

FIG. 8 is a block diagram illustrating one configuration of a wireless communication device 821 in which systems and methods for adaptively encoding and decoding a watermarked signal may be implemented. The wireless communication device 821 may be one example of electronic device A 102, electronic device B 134, wireless communication device A 402 or wireless communication device B 434 described above. The wireless communication device 821 may include an application processor 825. The application processor 825 generally processes instructions (e.g., runs programs) to perform functions on the wireless communication device 821. The application processor 825 may be coupled to an audio coder/decoder (codec) 819.

The audio codec 819 may be an electronic device (e.g., integrated circuit) used for coding and/or decoding audio signals. The audio codec 819 may be coupled to one or more speakers 811, an earpiece 813, an output jack 815 and/or one or more microphones 817. The speakers 811 may include one or more electro-acoustic transducers that convert electrical or electronic signals into acoustic signals. For example, the speakers 811 may be used to play music or output a speakerphone conversation, etc. The earpiece 813 may be another speaker or electro-acoustic transducer that can be used to output acoustic signals (e.g., speech signals) to a user. For example, the earpiece 813 may be used such that only a user may reliably hear the acoustic signal. The output jack 815 may be used for coupling other devices to the wireless communication device 821 for outputting audio, such as headphones. The speakers 811, earpiece 813 and/or output jack 815 may generally be used for outputting an audio signal from the audio codec 819. The one or more microphones 817 may be one or more acousto-electric transducers that convert an acoustic signal (such as a user's voice) into electrical or electronic signals that are provided to the audio codec 819.

The audio codec 819 may include an encoder 810*a*. The encoders 110, 410, 510, 710 described above may be examples of the encoder 810*a* (and/or encoder 810*b*). In an alternative configuration, an encoder 810*b* may be included in the application processor 825. One or more of the encoders 810*a-b* (e.g., the audio codec 819) may be used to perform the method 200 described above in connection with FIG. 2 for adaptively encoding a watermarked signal.

The audio codec 819 may additionally or alternatively include a decoder 840*a*. The decoders 140, 440, 640, 740 described above may be examples of the decoder 840*a* (and/or decoder 840*b*). In an alternatively configuration, a decoder 840*b* may be included in the application processor 825. One or more of the decoders 840*a-b* (e.g., the audio codec 819) may perform the method 300 described above in connection with FIG. 3 for decoding an adaptively encoded watermarked signal.

The application processor 825 may also be coupled to a power management circuit 835. One example of the power management circuit 835 is a power management integrated circuit (PMIC), which may be used to manage the electrical power consumption of the wireless communication device 821. The power management circuit 835 may be coupled to a battery 837. The battery 837 may generally provide electrical power to the wireless communication device 821.

The application processor 825 may be coupled to one or more input devices 839 for receiving input. Examples of input devices 839 include infrared sensors, image sensors, accelerometers, touch sensors, keypads, etc. The input devices 839 may allow user interaction with the wireless communication device 821. The application processor 825 may also be coupled to one or more output devices 841. Examples of output devices 841 include printers, projectors, screens, haptic devices, etc. The output devices 841 may allow the wireless communication device 821 to produce output that may be experienced by a user.

The application processor 825 may be coupled to application memory 843. The application memory 843 may be any electronic device that is capable of storing electronic information. Examples of application memory 843 include double data rate synchronous dynamic random access memory (DDRAM), synchronous dynamic random access memory (SDRAM), flash memory, etc. The application memory 843 may provide storage for the application processor 825. For instance, the application memory 843 may store data and/or instructions for the functioning of programs that are run on the application processor 825.

The application processor 825 may be coupled to a display controller 845, which in turn may be coupled to a display 847. The display controller 845 may be a hardware block that is used to generate images on the display 847. For example, the display controller 845 may translate instructions and/or data from the application processor 825 into images that can be presented on the display 847. Examples of the display 847 include liquid crystal display (LCD) panels, light emitting diode (LED) panels, cathode ray tube (CRT) displays, plasma displays, etc.

The application processor 825 may be coupled to a baseband processor 827. The baseband processor 827 generally processes communication signals. For example, the baseband processor 827 may demodulate and/or decode received signals. Additionally or alternatively, the baseband processor 827 may encode and/or modulate signals in preparation for transmission.

The baseband processor 827 may be coupled to baseband memory 849. The baseband memory 849 may be any electronic device capable of storing electronic information, such as SDRAM, DDRAM, flash memory, etc. The baseband processor 827 may read information (e.g., instructions and/or data) from and/or write information to the baseband memory 849. Additionally or alternatively, the baseband processor 827 may use instructions and/or data stored in the baseband memory 849 to perform communication operations.

The baseband processor 827 may be coupled to a radio frequency (RF) transceiver 829. The RF transceiver 829 may be coupled to a power amplifier 831 and one or more antennas 833. The RF transceiver 829 may transmit and/or receive radio frequency signals. For example, the RF transceiver 829 may transmit an RF signal using a power amplifier 831 and one or more antennas 833. The RF transceiver 829 may also receive RF signals using the one or more antennas 833.

Figure 9:
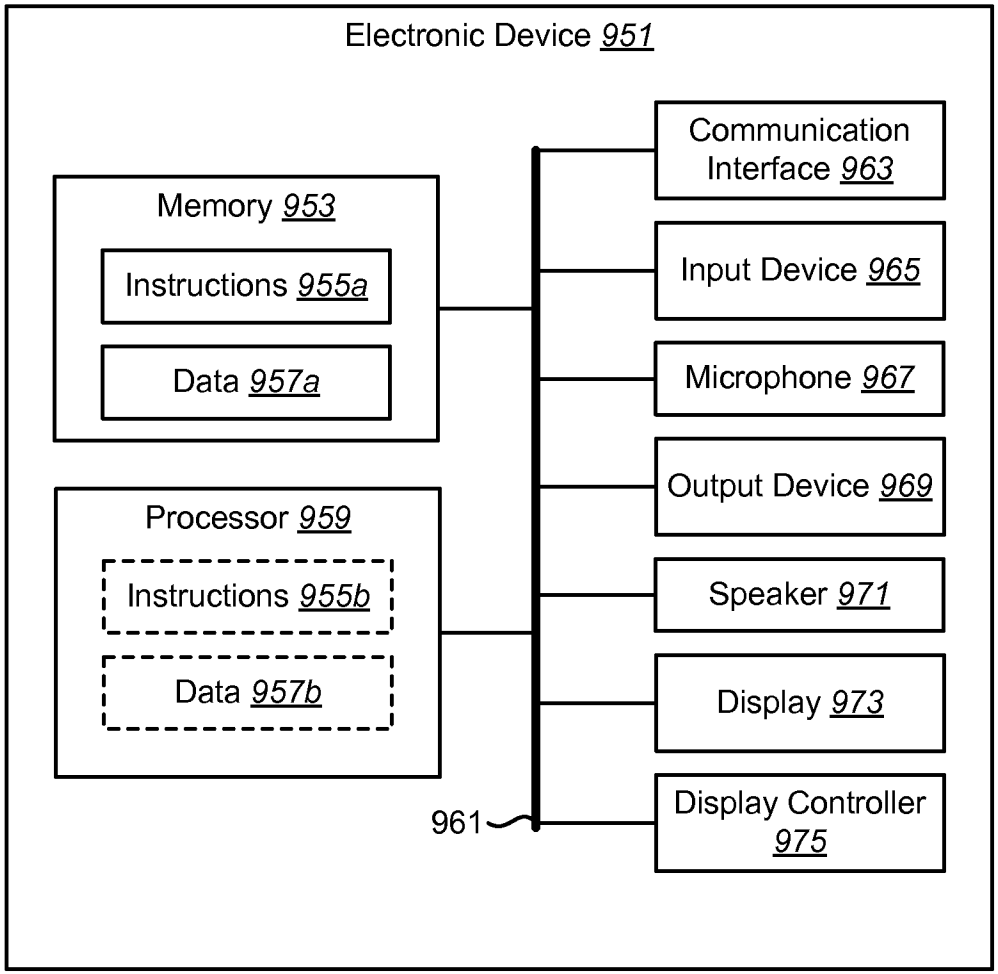
FIG. 9 illustrates various components that may be utilized in an electronic device.

FIG. 9 illustrates various components that may be utilized in an electronic device 951. The illustrated components may be located within the same physical structure or in separate housings or structures. One or more of the electronic devices 102, 134 described previously may be configured similarly to the electronic device 951. The electronic device 951 includes a processor 959. The processor 959 may be a general purpose single- or multi-chip microprocessor (e.g., an ARM), a special purpose microprocessor (e.g., a digital signal processor (DSP)), a microcontroller, a programmable gate array, etc. The processor 959 may be referred to as a central processing unit (CPU). Although just a single processor 959 is shown in the electronic device 951 of FIG. 9, in an alternative configuration, a combination of processors (e.g., an ARM and DSP) could be used.

The electronic device 951 also includes memory 953 in electronic communication with the processor 959. That is, the processor 959 can read information from and/or write information to the memory 953. The memory 953 may be any electronic component capable of storing electronic information. The memory 953 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 957*a* and instructions 955*a* may be stored in the memory 953. The instructions 955*a* may include one or more programs, routines, sub-routines, functions, procedures, etc. The instructions 955*a* may include a single computer-readable statement or many computer-readable statements. The instructions 955*a* may be executable by the processor 959 to implement one or more of the methods 200, 300 described above. Executing the instructions 955*a* may involve the use of the data 957*a* that is stored in the memory 953. FIG. 9 shows some instructions 955*b* and data 957*b* being loaded into the processor 959 (which may come from instructions 955*a* and data 957*a*).

The electronic device 951 may also include one or more communication interfaces 963 for communicating with other electronic devices. The communication interfaces 963 may be based on wired communication technology, wireless communication technology, or both. Examples of different types of communication interfaces 963 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 951 may also include one or more input devices 965 and one or more output devices 969. Examples of different kinds of input devices 965 include a keyboard, mouse, microphone, remote control device, button, joystick, trackball, touchpad, lightpen, etc. For instance, the electronic device 951 may include one or more microphones 967 for capturing acoustic signals. In one configuration, a microphone 967 may be a transducer that converts acoustic signals (e.g., voice, speech) into electrical or electronic signals. Examples of different kinds of output devices 969 include a speaker, printer, etc. For instance, the electronic device 951 may include one or more speakers 971. In one configuration, a speaker 971 may be a transducer that converts electrical or electronic signals into acoustic signals. One specific type of output device which may be typically included in an electronic device 951 is a display device 973. Display devices 973 used with configurations disclosed herein may utilize any suitable image projection technology, such as a cathode ray tube (CRT), liquid crystal display (LCD), light-emitting diode (LED), gas plasma, electroluminescence, or the like. A display controller 975 may also be provided, for converting data stored in the memory 953 into text, graphics, and/or moving images (as appropriate) shown on the display device 973.

The various components of the electronic device 951 may be coupled together by one or more buses, which may include a power bus, a control signal bus, a status signal bus, a data bus, etc. For simplicity, the various buses are illustrated in FIG. 9 as a bus system 961. It should be noted that FIG. 9 illustrates only one possible configuration of an electronic device 951. Various other architectures and components may be utilized.

Figure 10:
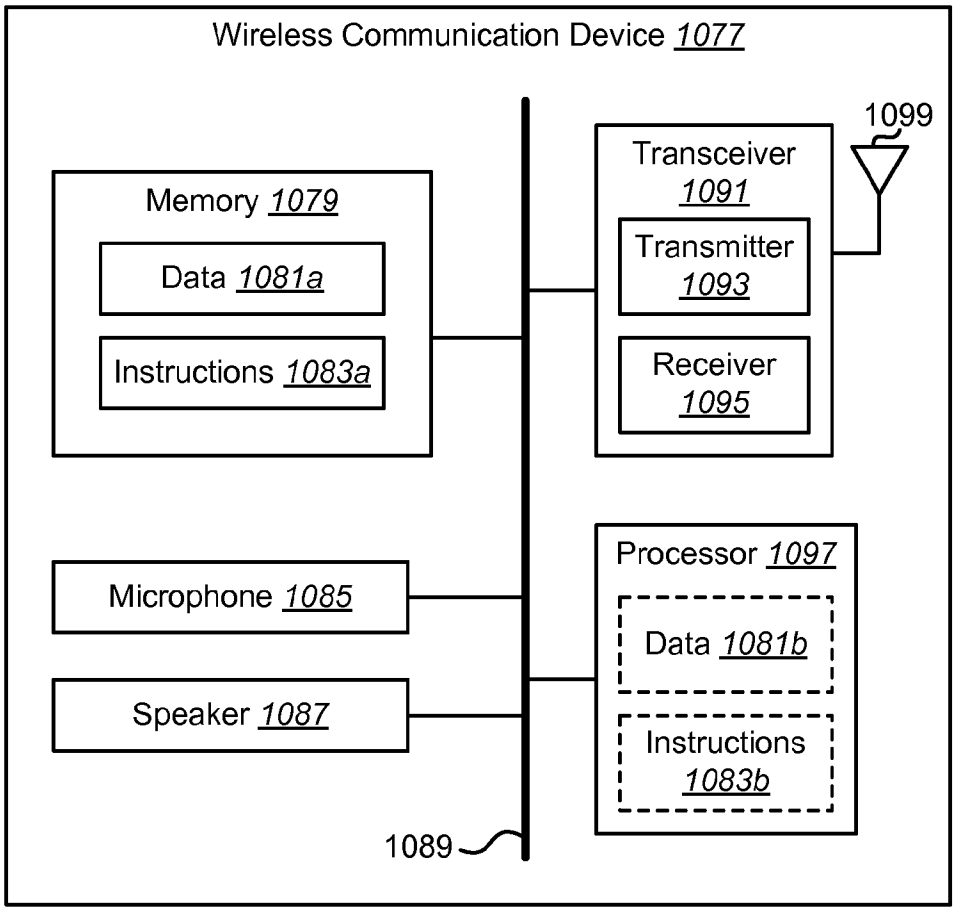
FIG. 10 illustrates certain components that may be included within a wireless communication device.

FIG. 10 illustrates certain components that may be included within a wireless communication device 1077. One or more of the electronic devices 102, 134, 951 and/or one or more of the wireless communication devices 402, 434, 821 described above may be configured similarly to the wireless communication device 1077 that is shown in FIG. 10.

The wireless communication device 1077 includes a processor 1097. The processor 1097 may be a general purpose single- or multi-chip microprocessor (e.g., an ARM), a special purpose microprocessor (e.g., a digital signal processor (DSP)), a microcontroller, a programmable gate array, etc. The processor 1097 may be referred to as a central processing unit (CPU). Although just a single processor 1097 is shown in the wireless communication device 1077 of FIG. 10, in an alternative configuration, a combination of processors (e.g., an ARM and DSP) could be used.

The wireless communication device 1077 also includes memory 1079 in electronic communication with the processor 1097 (i.e., the processor 1097 can read information from and/or write information to the memory 1079). The memory 1079 may be any electronic component capable of storing electronic information. The memory 1079 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1081*a* and instructions 1083*a* may be stored in the memory 1079. The instructions 1083*a* may include one or more programs, routines, sub-routines, functions, procedures, code, etc. The instructions 1083*a* may include a single computer-readable statement or many computer-readable statements. The instructions 1083*a* may be executable by the processor 1097 to implement one or more of the methods 200, 300 described above. Executing the instructions 1083*a* may involve the use of the data 1081*a* that is stored in the memory 1079. FIG. 10 shows some instructions 1083*b* and data 1081*b* being loaded into the processor 1097 (which may come from instructions 1083*a* and data 1081*a*).

The wireless communication device 1077 may also include a transmitter 1093 and a receiver 1095 to allow transmission and reception of signals between the wireless communication device 1077 and a remote location (e.g., another electronic device, wireless communication device, etc.). The transmitter 1093 and receiver 1095 may be collectively referred to as a transceiver 1091. An antenna 1099 may be electrically coupled to the transceiver 1091. The wireless communication device 1077 may also include (not shown) multiple transmitters, multiple receivers, multiple transceivers and/or multiple antenna.

In some configurations, the wireless communication device 1077 may include one or more microphones 1085 for capturing acoustic signals. In one configuration, a microphone 1085 may be a transducer that converts acoustic signals (e.g., voice, speech) into electrical or electronic signals. Additionally or alternatively, the wireless communication device 1077 may include one or more speakers 1087. In one configuration, a speaker 1087 may be a transducer that converts electrical or electronic signals into acoustic signals.

The various components of the wireless communication device 1077 may be coupled together by one or more buses, which may include a power bus, a control signal bus, a status signal bus, a data bus, etc. For simplicity, the various buses are illustrated in FIG. 10 as a bus system 1089.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer or processor. Disk and disc, as used herein, includes compact disc (CD), laser disc, optical disc, digital versatile disc (DVD), floppy disk and Blu-Ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. An electronic device configured for adaptively encoding a watermarked signal, comprising:

modeler circuitry that determines watermark data based on a first signal; and coder circuitry coupled to the modeler circuitry, wherein the coder circuitry determines at least one low priority codebook track of a second signal and embeds the watermark data into the at least one low priority codebook track of the second signal to produce a watermarked second signal.

2. The electronic device of claim 1, wherein the at least one low priority codebook track of the second signal is perceptually less important than another track of the second signal.

3. The electronic device of claim 1, wherein determining the at least one low priority codebook track of the second signal comprises:

determining one or more high priority codebook tracks based on the second signal; and designating any tracks that are not the one or more high priority codebook tracks as the at least one low priority codebook track.

4. The electronic device of claim 3, wherein determining the one or more high priority codebook tracks is based on a long term prediction (LTP) contribution.

5. The electronic device of claim 3, wherein determining the one or more high priority codebook tracks is based on a memory-limited long term prediction (LTP) contribution.

6. The electronic device of claim 3, wherein the one or more high priority codebook tracks are used to represent pitch.

7. The electronic device of claim 1, wherein the first signal is a higher frequency component signal and the second signal is a lower frequency component signal.

8. The electronic device of claim 1, wherein the modeler circuitry and the coder circuitry are included in an audio codec.

9. An electronic device for decoding an adaptively encoded watermarked signal, comprising:

portion determination circuitry that determines at least one low priority codebook track of a watermarked bitstream;

modeler circuitry coupled to the portion determination circuitry, wherein the modeler circuitry extracts watermark data from the at least one low priority codebook track of the watermarked bitstream and obtains a first signal based on the watermark data; and decoder circuitry that decodes the watermarked bitstream to obtain a second signal.

10. The electronic device of claim 9, wherein determining the at least one low priority codebook track of the watermarked bitstream is based on determining one or more high priority codebook codebook track based on the watermarked bitstream.

11. The electronic device of claim 10, wherein determining the one or more high priority codebook tracks is based on a long term prediction (LTP) contribution.

12. The electronic device of claim 10, wherein determining the one or more high priority codebook tracks is based on a memory-limited long term prediction (LTP) contribution.

13. The electronic device of claim 9, further comprising combining circuitry that combines the first signal and the second signal.

14. The electronic device of claim 9, wherein the at least one low priority codebook track of the watermarked bitstream includes information that is perceptually less important.

15. The electronic device of claim 9, wherein the portion determination circuitry, the modeler circuitry and the decoder circuitry are included in an audio codec.

16. A method for adaptively encoding a watermarked signal on an electronic device, comprising:

obtaining a first signal and a second signal;

determining at least one low priority codebook track of the second signal;

determining watermark data based on the first signal; and embedding the watermark data into the at least one low priority codebook track of the second signal to produce a watermarked second signal.

17. The method of claim 16, wherein the at least one low priority codebook track of the second signal is perceptually less important than another track of the second signal.

18. The method of claim 16, wherein determining the at least one low priority codebook track of the second signal comprises:

determining one or more high priority codebook tracks based on the second signal; and designating any tracks that are not the one or more high priority codebook tracks as the at least one low priority codebook track.

19. The method of claim 18, wherein determining the one or more high priority codebook tracks is based on a long term prediction (LTP) contribution.

20. The method of claim 18, wherein determining the one or more high priority codebook tracks is based on a memory-limited long term prediction (LTP) contribution.

21. The method of claim 18, wherein the one or more high priority codebook tracks are used to represent pitch.

22. The method of claim 16, wherein the first signal is a higher frequency component signal and the second signal is a lower frequency component signal.

23. The method of claim 16, wherein the method is performed by an audio codec.

24. A method for decoding an adaptively encoded watermarked bitstream on an electronic device, comprising:

receiving a signal;

extracting a watermarked bitstream based on the signal;

determining at least one low priority codebook track of the watermarked bitstream;

extracting watermark data from the at least one low priority codebook track of the watermarked bitstream;

obtaining a first signal based on the watermark data; and decoding the watermarked bitstream to obtain a second signal.

25. The method of claim 24, wherein determining the at least one low priority codebook track of the watermarked bitstream is based on determining one or more high priority codebook tracks based on the watermarked bitstream.

26. The method of claim 25, wherein determining the one or more high priority codebook tracks is based on a long term prediction (LTP) contribution.

27. The method of claim 25, wherein determining the one or more high priority codebook tracks is based on a memory-limited long term prediction (LTP) contribution.

28. The method of claim 24, further comprising combining the first signal and the second signal.

29. The method of claim 24, wherein the at least one low priority codebook track of the watermarked bitstream includes information that is perceptually less important.

30. The method of claim 24, wherein the method is performed by an audio codec.

31. A computer-program product for adaptively encoding a watermarked signal, comprising a non-transitory tangible computer-readable medium having instructions thereon, the instructions comprising:

code for causing an electronic device to obtain a first signal and a second signal;

code for causing the electronic device to determine at least one low priority codebook track of the second signal;

code for causing the electronic device to determine watermark data based on the first signal; and code for causing the electronic device to embed the watermark data into the at least one low priority codebook track of the second signal to produce a watermarked second signal.

32. The computer-program product of claim 31, wherein determining the at least one low priority codebook track of the second signal comprises:

determining one or more high priority codebook tracks based on the second signal; and designating any tracks that are not the one or more high priority codebook tracks as the at least one low priority codebook track.

33. A computer-program product for decoding an adaptively encoded watermarked bitstream, comprising a non-transitory tangible computer-readable medium having instructions thereon, the instructions comprising:

code for causing an electronic device to receive a signal;

code for causing the electronic device to extract a watermarked bitstream based on the signal;

code for causing the electronic device to determine at least one low priority codebook track of the watermarked bitstream;

code for causing the electronic device to extract watermark data from the at least one low priority codebook track of the watermarked bitstream;

code for causing the electronic device to obtain a first signal based on the watermark data; and code for causing the electronic device to decode the watermarked bitstream to obtain a second signal.

34. The computer-program product of claim 33, wherein determining the at least one low priority codebook track of the watermarked bitstream is based on determining one or more high priority codebook tracks based on the watermarked bitstream.

35. An apparatus for adaptively encoding a watermarked signal, comprising:

means for obtaining a first signal and a second signal;

means for determining at least one low priority codebook track of the second signal;

means for determining watermark data based on the first signal; and means for embedding the watermark data into the at least one low priority codebook track of the second signal to produce a watermarked second signal.

36. The apparatus of claim 35, wherein determining the at least one low priority codebook track of the second signal comprises:

determining one or more high priority codebook tracks based on the second signal; and designating any tracks that are not the one or more high priority codebook tracks as the at least one low priority codebook track.

37. An apparatus for decoding an adaptively encoded watermarked bitstream, comprising:

means for receiving a signal;

means for extracting a watermarked bitstream based on the signal;

means for determining at least one low priority codebook track of the watermarked bitstream;

means for extracting watermark data from the at least one low priority codebook track of the watermarked bitstream;

means for obtaining a first signal based on the watermark data; and means for decoding the watermarked bitstream to obtain a second signal.

38. The apparatus of claim 37, wherein determining the at least one low priority codebook track of the watermarked bitstream is based on determining one or more high priority codebook tracks based on the watermarked bitstream.

* * * * *